US008573588B2

(12) United States Patent
Sunohara

(10) Patent No.: US 8,573,588 B2
(45) Date of Patent: Nov. 5, 2013

(54) MEDIUM FEEDING CASSETTE AND IMAGE FORMING APPARATUS

(75) Inventor: Takahiro Sunohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 138 days.

(21) Appl. No.: 12/320,482

(22) Filed: Jan. 27, 2009

(65) Prior Publication Data

US 2009/0206545 A1 Aug. 20, 2009

(30) Foreign Application Priority Data

Feb. 15, 2008 (JP) ..... 2008-033912

(51) Int. Cl.
*B65H 1/00* (2006.01)

(52) U.S. Cl.
USPC ..... 271/145

(58) Field of Classification Search
USPC ..... 271/171, 145; 399/393
See application file for complete search history.

(56) References Cited

U.S. PATENT DOCUMENTS

| | | | | |
|---|---|---|---|---|
| 5,313,257 | A * | 5/1994 | Kashima et al. | 399/393 |
| 5,537,195 | A * | 7/1996 | Sagara et al. | 399/381 |
| 5,895,041 | A * | 4/1999 | Nishimura | 271/171 |
| 7,607,657 | B2 * | 10/2009 | Kawarago | 271/171 |
| 7,766,321 | B2 * | 8/2010 | Wada | 271/171 |
| 7,922,171 | B2 * | 4/2011 | Kawamura et al. | 271/171 |
| 2009/0295072 | A1 * | 12/2009 | Blair et al. | 271/171 |

FOREIGN PATENT DOCUMENTS

| | | |
|---|---|---|
| JP | 06-048590 | 2/1994 |

* cited by examiner

*Primary Examiner* — Luis A Gonzalez
(74) *Attorney, Agent, or Firm* — Rabin & Berdo, P.C.

(57) ABSTRACT

A medium feeding cassette includes a cassette main body, a cassette extension member mounted to the cassette main body so as to be movable with respect to the cassette main body, and a locking mechanism configured to lock the cassette extension member at a predetermined position with respect to the cassette main body according to a size of the medium. The locking mechanism includes a locking member and a first locking groove that engage each other so as to lock the cassette extension member in the predetermined position. The locking member moves in a direction to release locking of the cassette extension member when a force is applied to the cassette extension member in a direction to retract the cassette extension member into the cassette main body.

37 Claims, 16 Drawing Sheets

MEDIUM FEEDING CASSETTE AND IMAGE FORMING APPARATUS

BACKGROUND OF THE INVENTION

The present invention relates to an image forming apparatus, and particularly relates to a medium feeding cassette for storing a medium (for example, a recording sheet) to be fed to a main body of the image forming apparatus.

In a conventional sheet feeding cassette, a cassette extension member (i.e., a slide member) is mounted to a cassette main body so as to be movable with respect to the cassette main body. The cassette extension member is locked by a locking mechanism in a predetermined position with respect to the cassette main body. To be more specific, in order to enlarge a space for storing recording sheets, the cassette extension member is slid to a protruding position from the cassette main body and is locked therein. Such a sheet feeding cassette is disclosed in, for example, Japanese Laid-open Patent Publication No. H6-48590 (Page 3, FIG. 1).

SUMMARY OF THE INVENTION

The present invention is intended to provide a medium feeding cassette and an image forming apparatus capable of preventing application of unwanted force thereto.

The present invention provides a medium feeding cassette for storing a medium. A medium feeding cassette includes a cassette main body, a cassette extension member mounted to the cassette main body so as to be movable with respect to the cassette main body, and a locking mechanism configured to lock the cassette extension member in a predetermined position with respect to the cassette main body according to a size of the medium. The locking mechanism includes a locking member and a first locking groove that engage each other so as to lock the cassette extension member in the predetermined position. The locking member moves in a direction to release locking of the cassette extension member when a fore is applied to the cassette extension member in a direction to retract the cassette extension member into the cassette main body.

With such an arrangement, when a force is applied to the cassette extension member in the direction to retract the cassette extension member into the cassette main body (in a state where the cassette extension member protrudes from the cassette main body), the locking member moves in a direction to release the locking of the cassette extension member. Therefore, application of unwanted force to the medium feeding cassette can be prevented even when an excessive force is applied to the cassette extension member. Further, operation for retracting the cassette extension member can be simplified.

The present invention also provides a medium feeding cassette for storing a medium. The medium feeding cassette includes a cassette main body, and a cassette extension member mounted to the cassette main body so as to be movable with respect to the cassette main body. The cassette extension member includes a rear end guide member that defines an upstream end of the medium in a feeding direction of the medium, and a to-be-guided portion guided by a bottom portion of the cassette main body. The bottom portion is configured to define a placing surface on which the medium is placed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, an embodiment of the present invention will be described with reference to the attached drawings.

Embodiment 1

Figure 1:
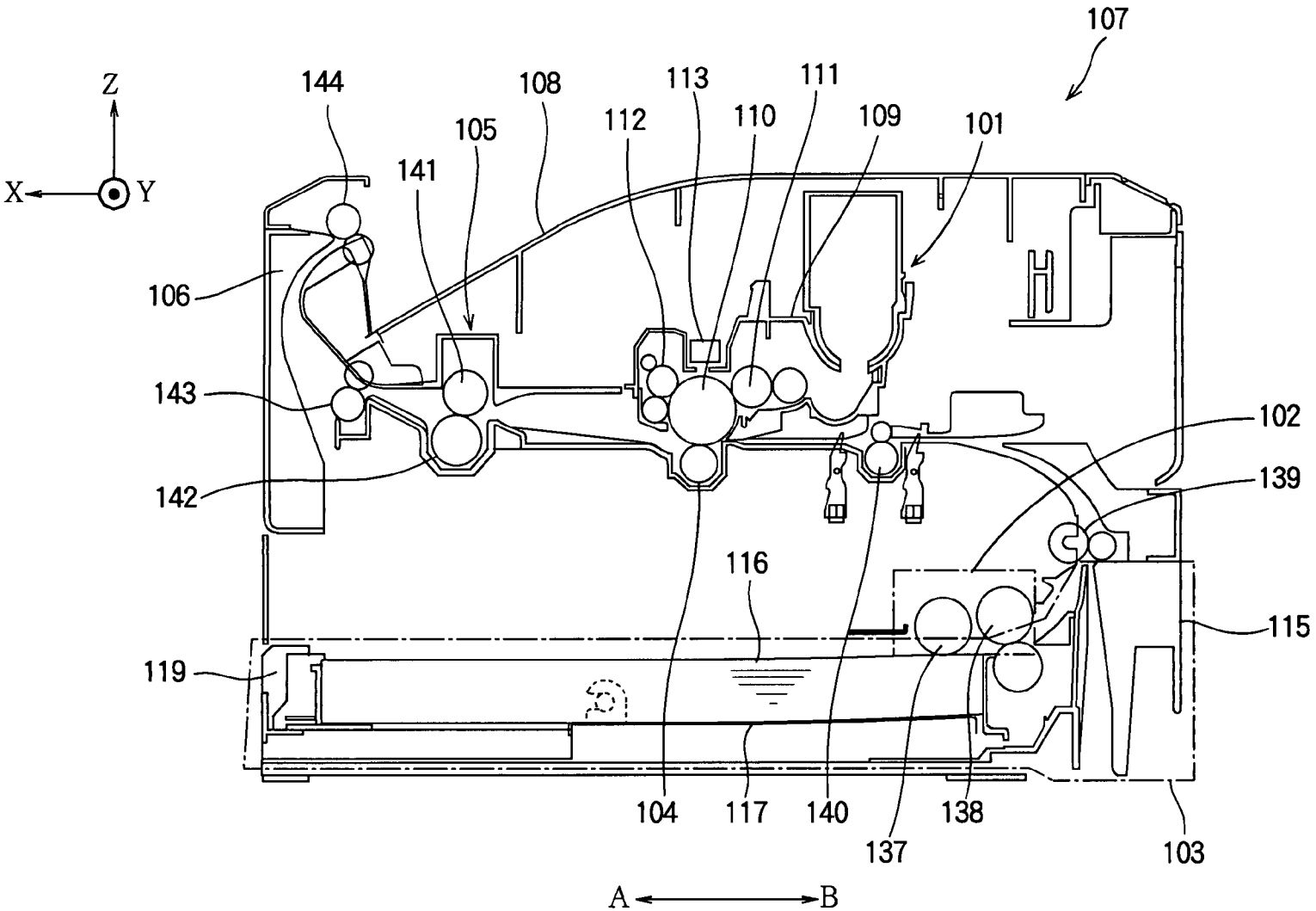
FIG. 1 is a side sectional view schematically showing a configuration of an image forming apparatus employing a sheet feeding cassette according to Embodiment 1 of the present invention.

FIG. 1 is a side sectional view schematically showing a configuration of an image forming apparatus employing a sheet feeding cassette according to Embodiment 1 of the present invention.

As shown in FIG. 1, an image forming apparatus 107 is configured to print an image on a recording sheet 116 (i.e., a medium) using electrophotographic technique based on image data sent from an external computer or the like. The image forming apparatus 107 includes an image forming portion 101, a sheet feeding unit 102 (i.e., a medium feeding unit), a sheet feeding cassette 103 (i.e., a medium feeding cassette), a transfer roller 104, a fixing unit 105, a sheet ejection unit 106 and a stacking portion 108 for stacking printed recording sheets 116.

The image forming portion 101 includes an image drum cartridge 109 and an optical unit 113. The image drum cartridge 109 includes a photosensitive body 110 as an image bearing body in the form of a drum, a developing unit 111 and a charging unit 112. The optical unit 113 is disposed above the photosensitive body 110, and is composed of an LED head having LED elements arranged in an axial direction of the photosensitive body 110. In this regard, the optical unit 113 can also be composed of a laser scanning unit having a laser emitting portion and a polygon mirror.

In FIG. 1, X-direction, Y-direction and Z-direction are defined as follows. The X-direction is defined as a feeding direction of the recording sheet 116 when the recording sheet 116 passes the image forming portion 101. The Y-direction is defined as the axial direction of the photosensitive body 110. The Z-direction is defined as being perpendicular to both of the X-direction and Y-direction. The X-direction, Y-direction and Z-direction in other figures indicate the same directions as those shown in FIG. 1. In other words, the X-direction, Y-direction and Z-direction of the respective figures indicate orientations of respective parts shown in the figures when the parts constitute the image forming apparatus 107 shown in FIG. 1.

The sheet feeding cassette 103 is attached to a lower part of a main body of the image forming apparatus 107 as shown in FIG. 1. The sheet feeding cassette 103 is horizontally slid in the direction shown by an arrow A into the main body of the image forming apparatus 107 in such a manner that guide grooves 114 (see FIG. 2) formed on both side walls of the sheet feeding cassette 103 slidably engage not shown rails in the main body of the image forming apparatus 107. In this regard, parts of the image forming apparatus 107 except detachable components such as the sheet feeding cassette 103 is referred to as the main body of the image forming apparatus 107.

The sheet feeding unit 102 is provided in the main body of the image forming apparatus 107, and is located above a front part (i.e., right in FIG. 1) of the sheet feeding cassette 103. The sheet feeding unit 102 includes a pickup roller 137 and supplying rollers 138, and feeds the recording sheet 116 in the direction shown by the arrow B in FIG. 1.

First conveying rollers 139 and second conveying rollers 140 are disposed between the sheet feeding unit 102 and the image forming portion 101 along a sheet feeding path.

The fixing unit 105 is disposed on the downstream side of the image forming portion 101 along the sheet feeding path, and includes a heat roller 141 and a pressure roller 142 that apply heat and pressure to the recording sheet 116 so as to fix the image to the recording sheet 116.

The sheet ejection unit 106 is disposed on the downstream side of the fixing unit 105 along the sheet feeding path, and includes third conveying rollers 143 and fourth conveying rollers 144 for ejecting the recording sheet 116 to the outside of the main body of the image forming apparatus 107.

Figure 2:
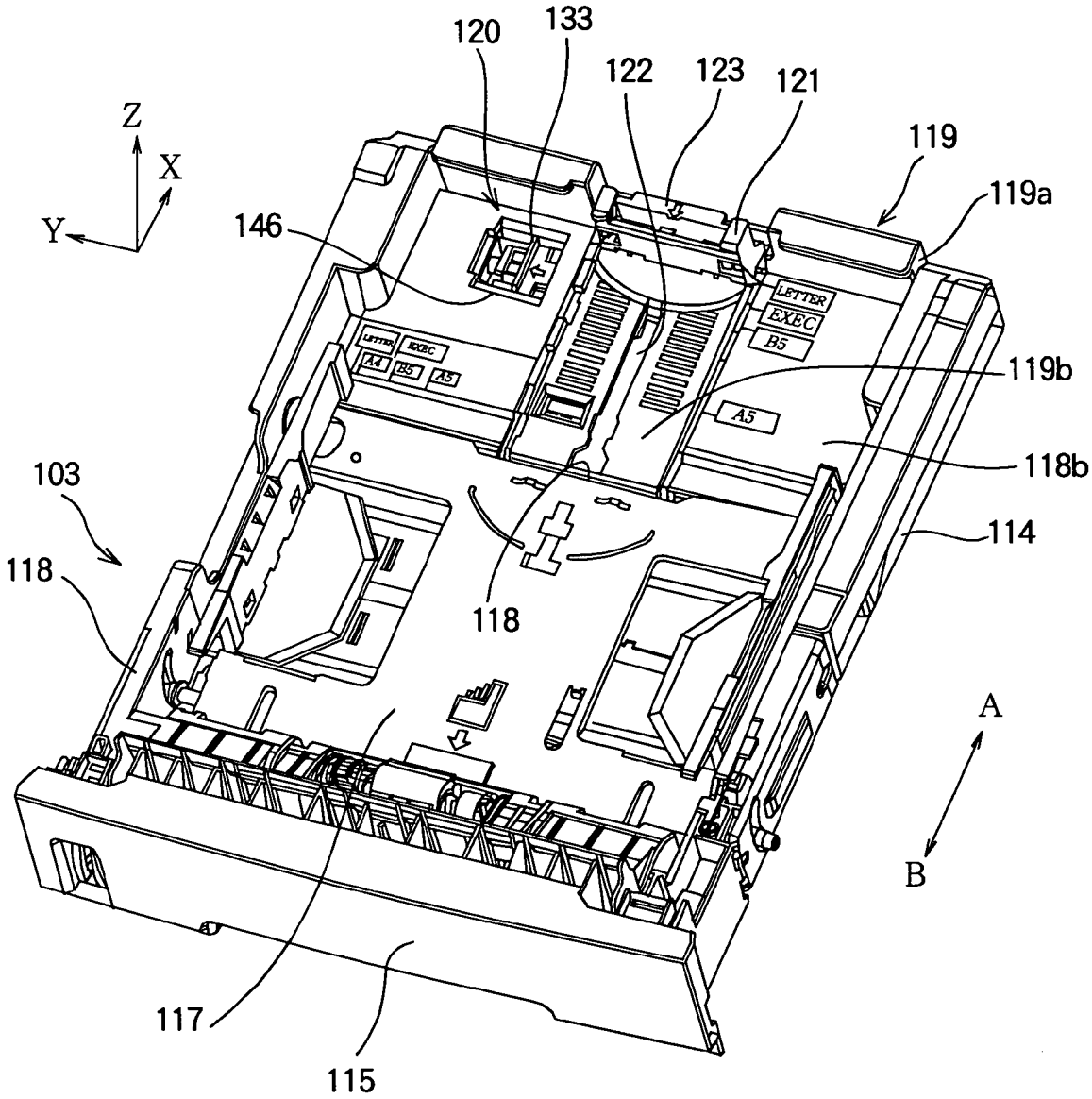
FIG. 2 is a perspective view showing the sheet feeding cassette according to Embodiment 1.
Figure 3:
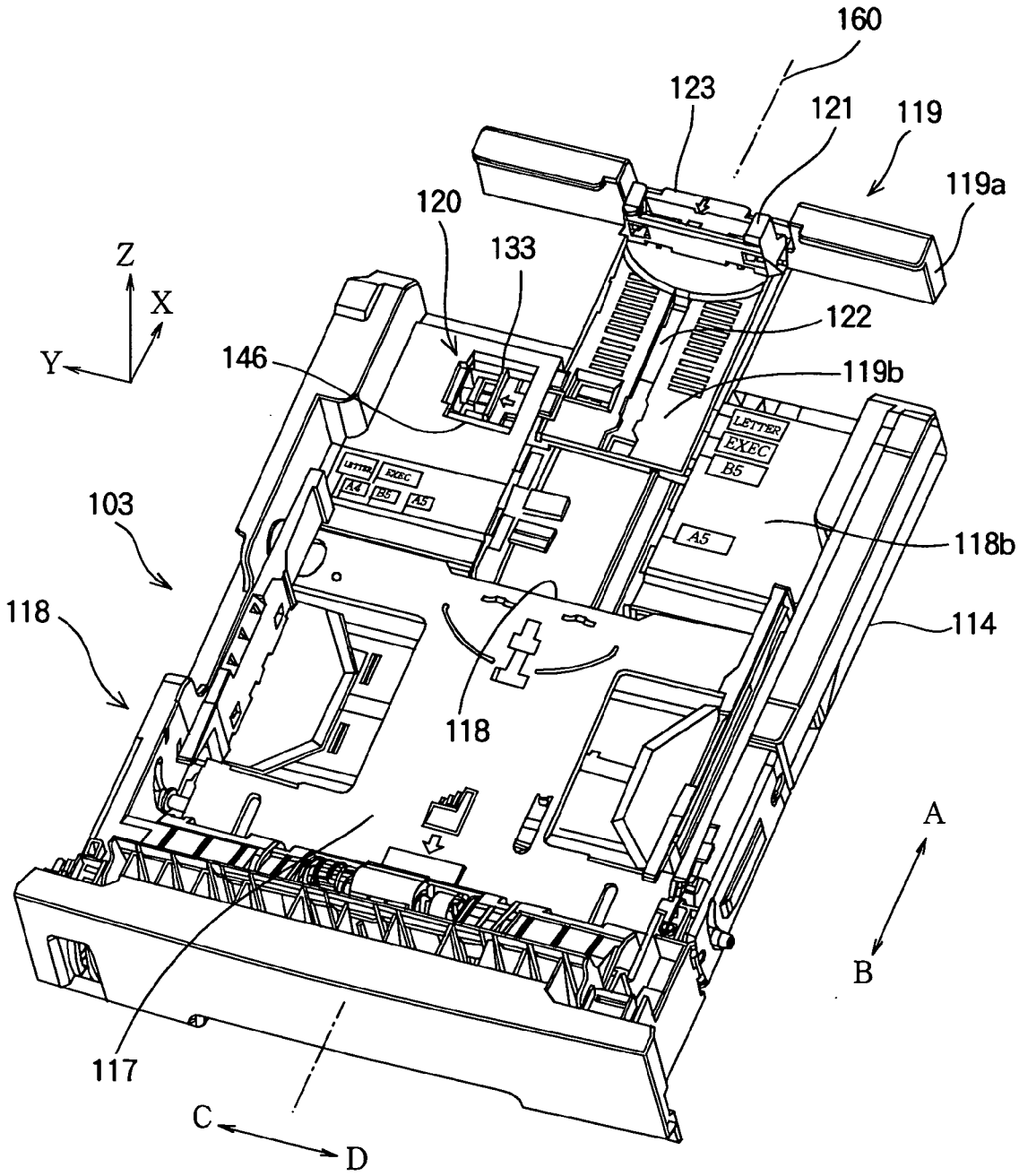
FIG. 3 is a perspective view showing the sheet feeding cassette according to Embodiment 1 in a state where a slide member is in an enlarging position.

FIG. 2 is a perspective view showing the sheet feeding cassette 103 according to Embodiment 1. FIG. 3 is a perspective view showing the sheet feeding cassette 103 in a state where a slide member thereof is in an enlarging position.

The sheet feeding cassette 103 has a front cover 115 on a front end thereof (i.e., an end in the direction shown by an arrow B). The front cover 115 constitutes a lower part of a front housing of the image forming apparatus 107 shown in FIG. 1. The sheet feeding cassette 103 is in the form of a flat box that opens upward, so that the recording sheets 116 (FIG. 1) can be set in the sheet feeding cassette 103 from above. A sheet placing plate 117 (i.e., a medium placing plate) is provided in the sheet feeding cassette 103, on which the recording sheets 116 (FIG. 1) are placed. The recording sheets 116 placed on the sheet placing plate 117 are fed in the direction shown by the arrow B by means of the above described sheet feeding unit 102 located above the front part of the sheet feeding cassette 103. For this purpose, the sheet placing plate 117 is biased upward by a not shown spring so that the uppermost recording sheet 116 abuts against the pickup roller 137 (FIG. 1) of the sheet feeding unit 102.

The sheet feeding cassette 103 includes a cassette main body 118 and a slide member 119 (i.e., a cassette extension member) slidably mounted to the cassette main body 118. The slide member 119 is configured to support an upstream part of the recording sheet 116 in the feeding direction of the recording sheet 116 shown by the arrow B. Further, the slide member 119 is movable in the direction shown by the arrow A with respect to the cassette main body 118 according to a size of the recording sheet 116. As shown in FIG. 3, when the slide member 119 is slid in the direction shown by the arrow A, an area for placing the recording sheet 116 in the sheet feeding cassette 103 is enlarged. As will be described later, the slide member 119 is not entirely pulled out of the cassette main body 118 from the state shown in FIG. 3. That is, a locking mechanism 120 is mounted to the cassette main body 118 and the slide member 119, which locks movement of the slide member 119.

As shown in FIG. 3, the slide member 119 includes a rear cover portion **119*a* that defines a rear end (i.e., an end in the direction shown by the arrow A) of the sheet feeding cassette 103 and a to-be-guided portion 119*b* extending frontward from a widthwise center of the rear cover portion 119*a*. The to-be-guided portion 119*b* has first and second locking grooves 124*a* and 124*b*. The to-be-guided portion 119*b* supports a sheet rear end guide 121 (i.e., a rear end guide member) that defines the rear ends of the recording sheets 116. The to-be-guided portion 119*b* engages a guide concave 118*a* formed in a rear part of the cassette main body 118. The guide concave 118*a* guides the to-be-guided portion 119*b* so that the to-be-guided portion 119*b* is movable in directions indicated by the arrows A and B. An upper surface of the to-be-guided portion 119*b* is substantially aligned with an upper surface of a bottom plate 118*b* of the cassette main body 118 where the guide concave 118*a*** is formed.

The bottom plate **118*b* (i.e., a bottom portion) of the cassette main body 118 and the sheet placing plate 117 define a sheet placing surface of the sheet feeding cassette 103, on which the recording sheets 116 are placed. The slide member 119 is guided by a sliding contact between the to-be-guided portion 119*b* and the guide concave 118*a*. The guide concave 118*a* extends in the direction shown by the arrow B from the rear end portion (i.e., the end in the direction shown by the arrow A) of the cassette main body 118**. The guide concave

118*a* is disposed on a widthwise center portion of the cassette main body 118 (i.e., a center portion in the Y-direction). To be more specific, a widthwise center line of the guide concave 118*a* (i.e., a line defining a center in the direction shown by arrows C and D perpendicular to the direction shown by the arrows A and B) is substantially aligned with a widthwise center line 160 of the cassette main body 118.

In this regard, if the bottom surface and both side surfaces (both extending in the X-direction) of the slidable member 119 are overlapped with the cassette main body 118, a friction between the slide member 119 and the cassette main body 118 may become large when the slide member 119 moves in the directions shown by the arrows A and B. In such a case, the slide member 119 may become less movable, or may become unable to move (when a large amount of recording sheets 116 are placed thereon), and the sheet feeding cassette 103 may become heavier. In contrast, according to this embodiment, the slide member 119 is so configured that only the to-be-guided portion 119*b* slidably contacts the guide concave 118*a* of the cassette main body 118 as described above. With such a configuration, a load required to move the slide member 119 can be reduced, and a weight of the entire sheet feeding cassette 103 can be reduced.

The sheet rear end guide 121 that guides the rear end (i.e., the end in the direction shown by the arrow A) of the recording sheet 116 engages a slit portion 122 formed on the to-be-guided portion 119*b* of the slide member 119 so as to be slidably movable. The slit portion 122 is formed in the widthwise center portion of the to-be-guided portion 119*b*, and extends in the direction shown by the arrow B from the vicinity of the rear cover portion 119*a*. With such a configuration, after the slide member 119 is set to a retracted position as shown in FIG. 2 or an enlarging position as shown in FIG. 3, the sheet rear end guide 121 can be adjusted so as to guide the rear ends of the stacked recording sheets 116. The sheet rear end guide 121 is locked by a locking lever 123 with respect to the to-be-guided portion 119*b* of the slide member 119.

Figure 4:
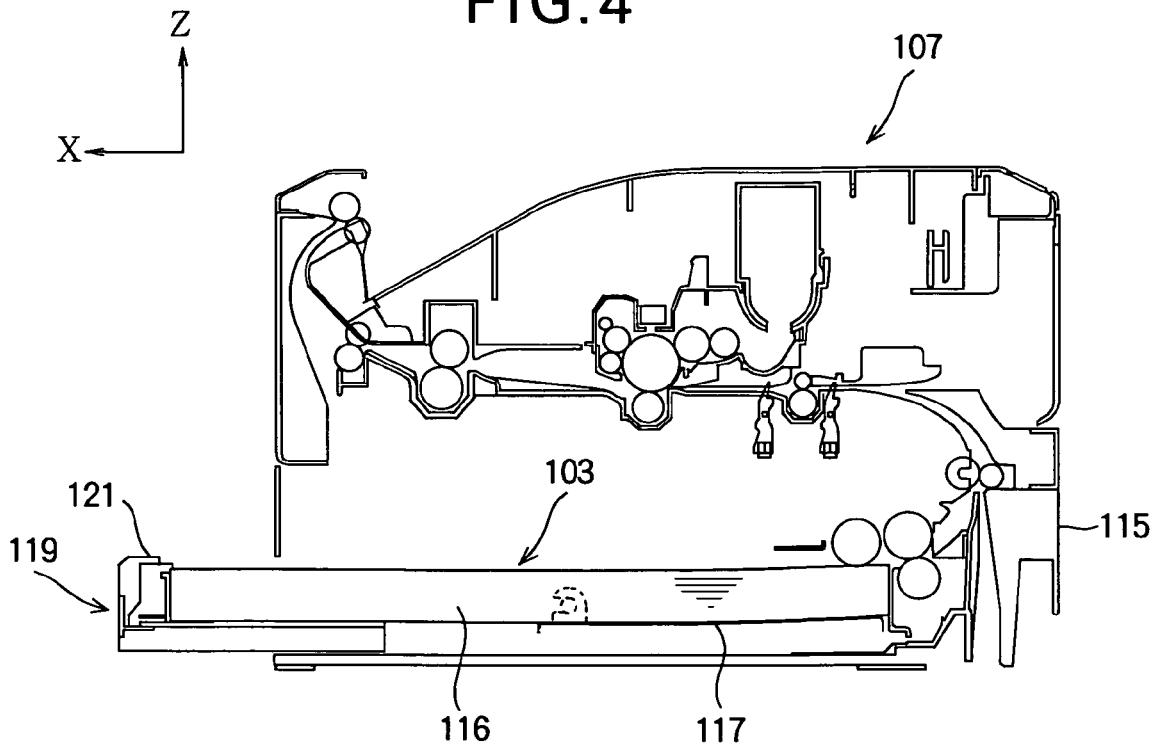
FIG. 4 is a sectional view showing a configuration of the image forming apparatus to which the sheet feeding cassette according to Embodiment 1 is attached in a state where the slide member is in the enlarging position.

FIG. 4 is a schematic view showing a configuration of the image forming apparatus 107 to which the sheet feeding cassette 103 is attached in a state where the slide member 119 is in the enlarging position (i.e., a protruding position). As shown in FIG. 4, when the sheet feeding cassette 103 is attached to the image forming apparatus 107 in a state where the slide member 119 is in the enlarging position, the slide member 119 protrudes from the main body of the image forming apparatus 107.

Figure 5:
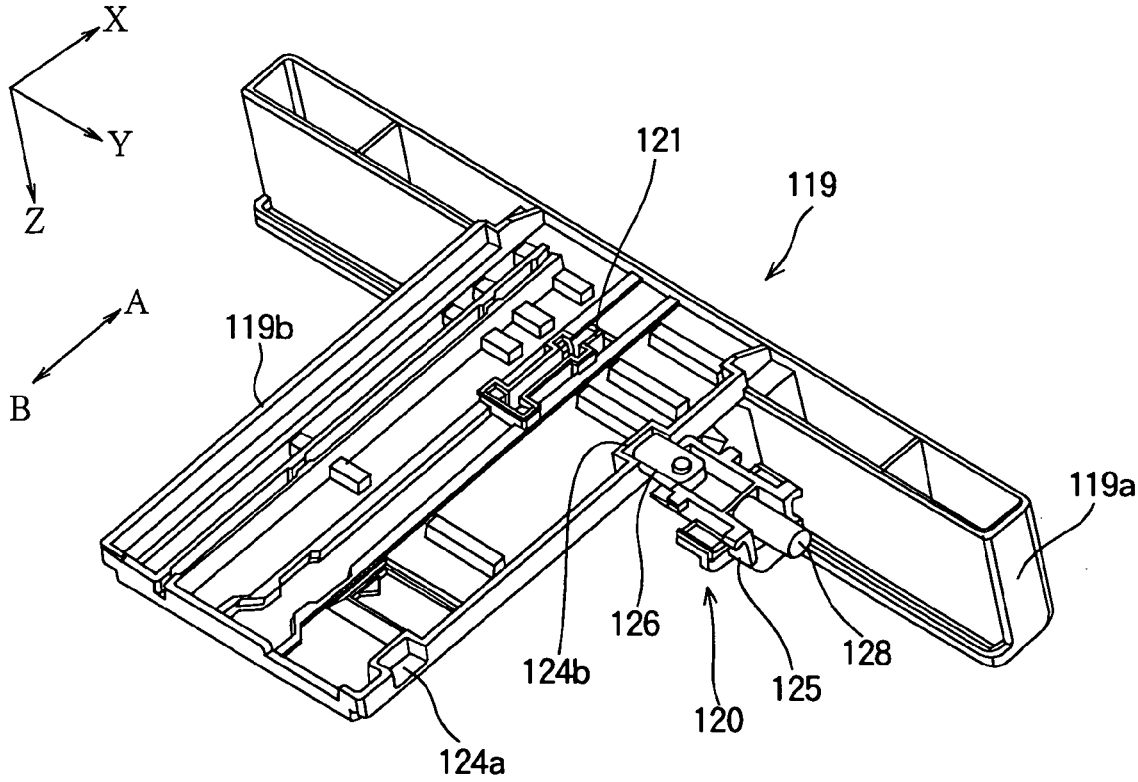
FIG. 5 is a bottom perspective view showing a locking mechanism together with the slide member according to Embodiment 1.
Figure 6:
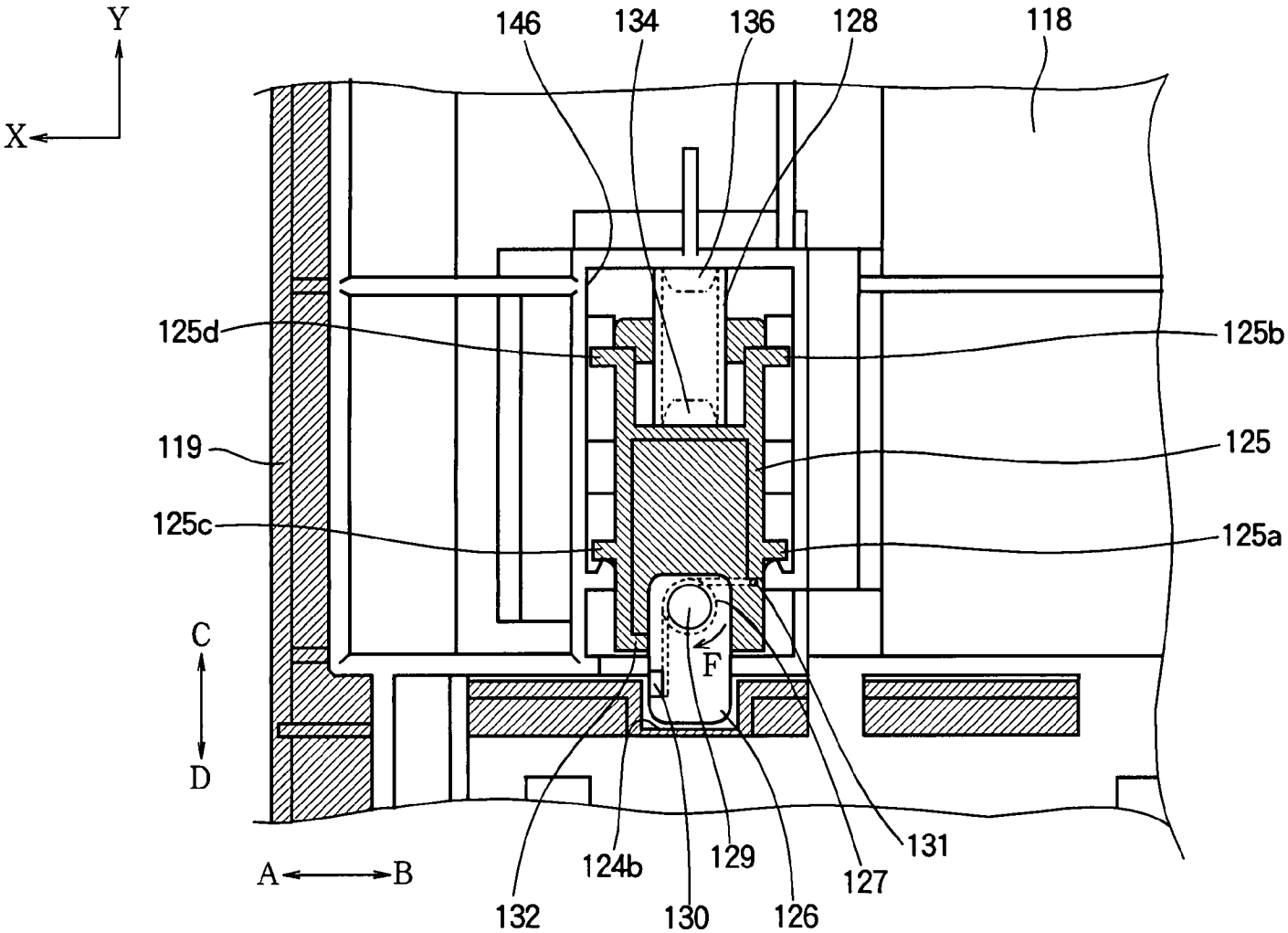
FIG. 6 is a schematic bottom view for illustrating operation of the locking mechanism mounted to the cassette main body and the slide member according to Embodiment 1 for illustrating operation thereof.
Figure 7:
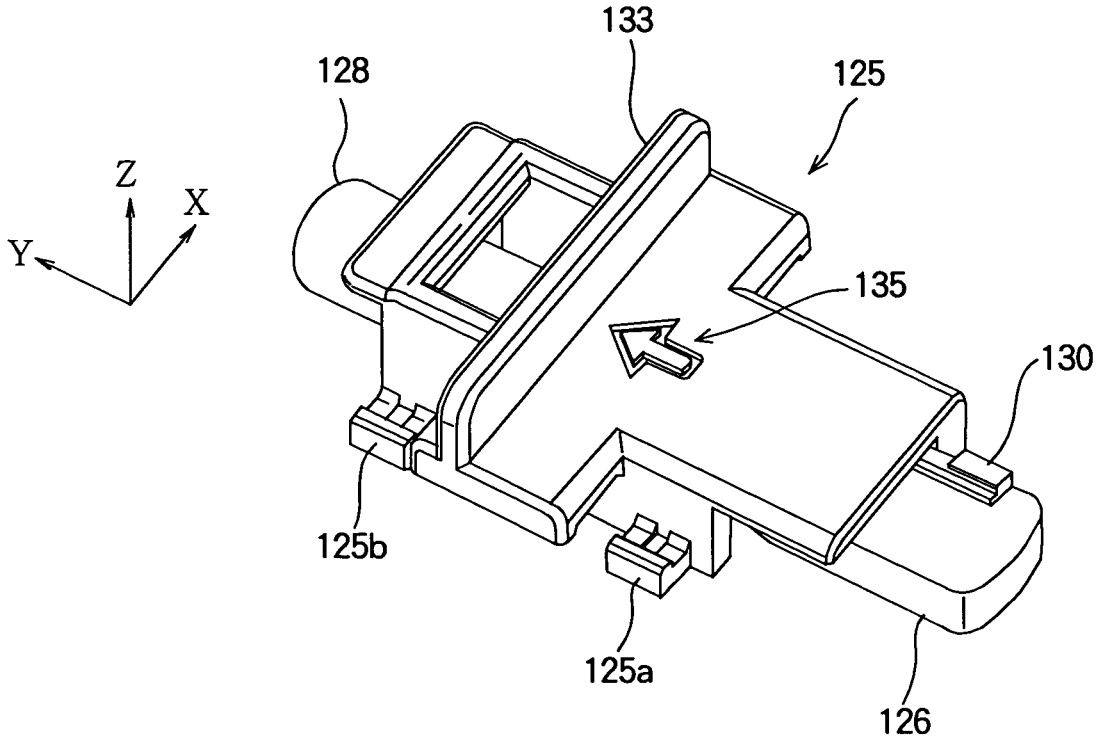
FIG. 7 is a perspective view showing a slide lever, an arm lever and a spring of the locking mechanism according to Embodiment 1.

Next, the locking mechanism 120 of the sheet feeding cassette 103 will be described with reference to FIGS. 5 through 7. FIG. 5 is a bottom perspective view showing the locking mechanism 120 together with the slide member 119 supporting the sheet rear end guide 121. FIG. 6 is a schematic bottom view for illustrating operation of the locking mechanism 120 mounted to the cassette main body 118 and the slide member 119. FIG. 7 is a perspective view showing a slide lever 125, an arm lever 126 and a spring 128 of the locking mechanism 120. In FIG. 6, the slide member 119 is shown with hatching slanting downwardly to the left, and the slide lever 125 of the locking mechanism 120 is shown with hatching slanting downwardly to the right.

As shown in FIG. 5, the locking mechanism 120 includes the first and second locking grooves 124*a* and 124*b*, the slide lever 125, the arm lever 126, a torsion spring 127 (FIG. 6) and the spring 128. The first locking groove 124*a* and the second locking groove 124*b* are disposed on the slide member 119. The other components (i.e., the slide lever 125, the arm lever 126, the torsion spring 127 and the spring 128) are mounted to the cassette main body 118.

The locking grooves 124*a* and 124*b* are disposed on positions apart from each other in the feeding direction of the recording sheet 116 (i.e., the movable direction of the slide member 119). To be more specific, the first locking groove 124*a* and the second locking groove 124*b* are respectively disposed on the downstream side and the upstream side along the feeding direction of the recording sheet 116 shown by the arrow B.

FIGS. 5 and 6 show a state where the arm lever 126 engages the second locking groove 124*b*. The slide lever 125, the arm lever 126 and the torsion spring 127 (that constitute a locking member) and the spring 128 are held in a locking member holding portion 146 (FIG. 6) formed on the cassette main body 118. The slide lever 125 is supported by the locking member holding portion 146 slidably in the widthwise direction of the recording sheet 116 (i.e., the Y-direction) which is perpendicular to the moving direction of the slide member 119 shown by the arrows A and B. The slide lever 125 has four projections 125*a*, 125*b*, 125*c* and 125*d* guided in the Y-direction by not shown guide members formed in the cassette main body 118, which define a movable range of the slide lever 125.

The arm lever 126 (i.e., a first lever) is rotatable about a rotation shaft 129 disposed on the slide lever 125 as shown in FIG. 6. The torsion spring 127 (i.e., a second biasing unit) is disposed around the rotation shaft 129 of the slide lever 125. An end of the torsion spring 127 abuts against a projection 130 (see FIG. 7) disposed on the arm lever 126, and the other end of the torsion spring 127 fits in a receiving hole 131 formed in the slide lever 125. With this, the arm lever 126 is biased in a rotational direction shown by an arrow F and abuts against a stopper portion 132 of the slide lever 125. The arm lever 126 engages the second locking groove 124*b* and the first locking groove 124*a* (FIG. 5) at predetermined timings, as will be described later.

As shown in FIGS. 2 and 7, the slide lever 125 has an operation portion 133 which can be manually operated with a finger for moving the slide lever 125. In this regard, the bottom plate 118*b* has a rectangular opening leading to the locking member holding portion 146, so that the operation portion 133 is accessible from above. The slide lever 125 has a pin 134 (FIG. 6) at an end thereof, which receives an end of the spring 128. The pin 134 is disposed so that an axial direction thereof is oriented in the direction parallel to the moving direction of the slide lever 125. Further, an arrow 135 (i.e., an indication mark) is formed integrally on an upper surface of the slide lever 125 as shown in FIG. 7, which indicates a direction from a locking position to a lock-releasing position.

As shown in FIG. 6, the spring 128 (i.e., a first biasing unit) is set in a compressed manner so that an end of the spring 128 engages a pin 136 (as a receiving portion) disposed on the cassette main body 118 and the other end of the spring 128 engages the above described pin 134. The spring 128 (for example, a compression spring) biases the slide lever 125 in the direction shown by the arrow D, i.e., the direction from the lock-releasing position to the locking position.

Next, operation of the image forming apparatus 107 will be described.

In FIG. 1, the recording sheet 116 in the sheet feeding cassette 103 is picked up by the pickup roller 137 of the sheet feeding unit 102, and the recording sheet 116 is fed out of the sheet feeding cassette 103 by the supplying rollers 138. Further, the recording sheet 116 is conveyed by the first conveying rollers 139 and the second conveying rollers 140 to reach the image forming portion 101. In the image forming portion 101, the recording sheet 116 is sandwiched by the photosensitive body 110 and the transfer roller 104. In the image forming portion 101, the charging unit 112 uniformly charges the surface of the photosensitive body 110, and the exposing unit 113 exposes the surface of the photosensitive body 110 to form a latent image thereon. The developing unit 111 develops the latent image with toner. The toner image formed on the photosensitive body 110 is transferred to the recording sheet 116 by means of the transfer roller 104. Then, the recording sheet 116 is conveyed to the fixing unit 105 where the recording sheet 116 is sandwiched by the heat roller 141 (controlled at a predetermined temperature) and the pressure roller 142 so that the toner image is fixed to the recording sheet 116 due to thermal compression. Then, the recording sheet 116 is further conveyed by the third conveying rollers 143 and the fourth conveying rollers 144 to the outside of the main body of the image forming apparatus 107. The ejected recording sheet 116 is placed on the stacker portion 108 formed on an upper surface of the main body of the image forming apparatus 107 in such a manner that an image-formed surface of the recording sheet 116 faces downward. With this, the image forming operation is completed.

Figure 10:
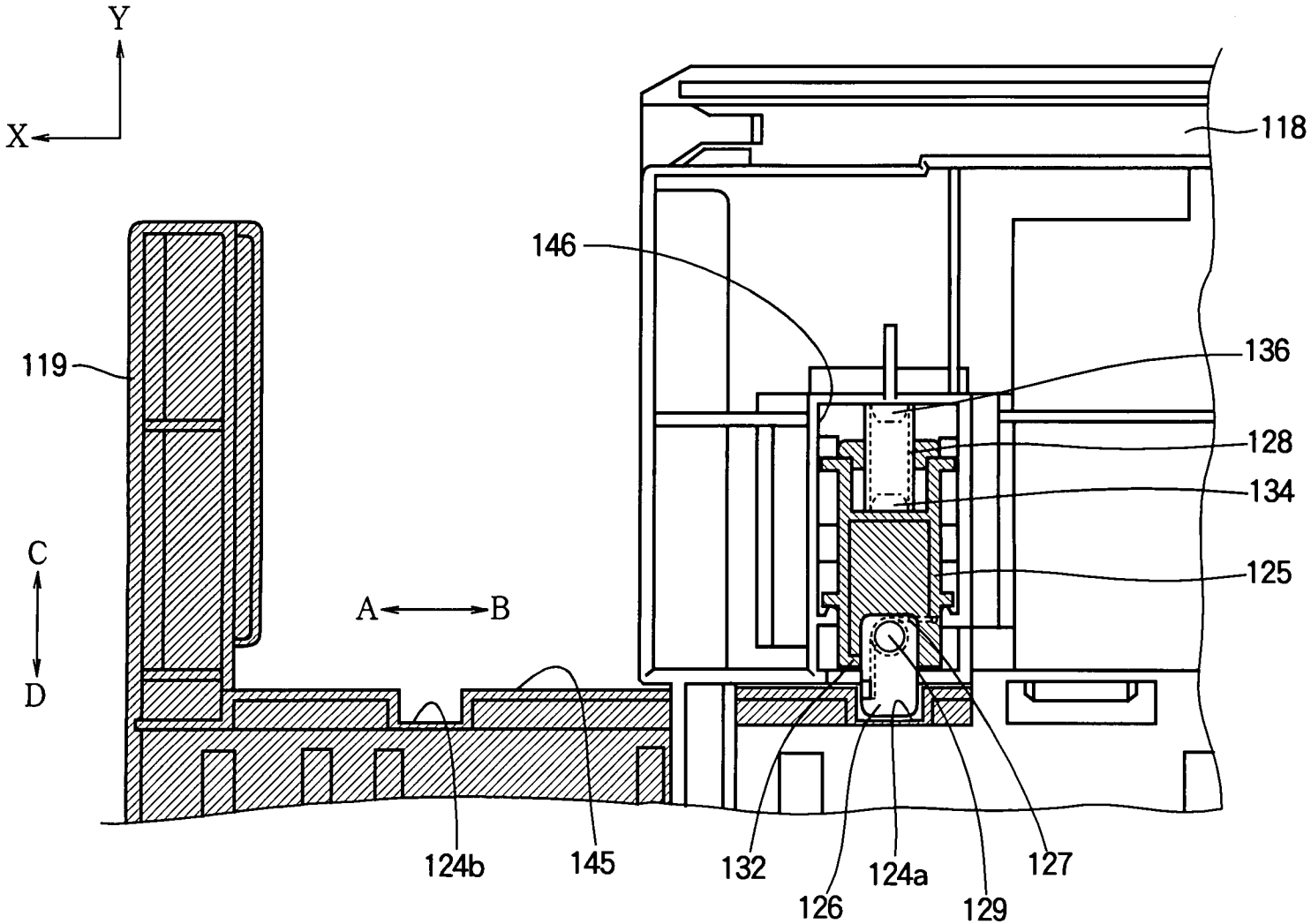
FIG. 10 is a schematic bottom view for illustrating operation of the locking mechanism mounted to the cassette main body and the slide member according to Embodiment 1.

A transition process of the slide member 119 from the retracted position (FIG. 2) to the enlarging position (FIG. 3) will be described. To be more specific, in the retracted position, the slide member 119 is retracted into the cassette main body 118 as shown in FIG. 2, and is locked therein due to the engagement between the arm lever 126 and the second locking groove 124*b* as shown in FIGS. 5 and 6. In the enlarging position, the slide member 119 protrudes from the cassette main body 118 as shown in FIG. 3, and is locked therein due to the engagement between the arm lever 126 of the locking member and the first locking groove 124*a* as shown in FIG. 10. When in the retracted position the cassette main body 118 has a supporting portion that supports the rear cover 119*a* in the retracted position. As illustrated in FIG. 3, when the slide member 119 is in the enlarging position and protrudes from the cassette main body 118, a space is formed between the rear cover 119*a* and a portion of said cassette main body 118 that is positioned further upstream in the feeding direction of the medium printing direction than any other portion of said cassette main body 118. In the enlarging position, the to-be-guided portion 119*b* includes a holding portion that holds the medium in a state where the slide member 119 extends from the cassette main body 118. Further, as illustrated in FIGS. 3 and 5, the rear cover portion 119*a* has a brim which is distanced from a bottom portion of the cassette main body 118.

Figure 8:
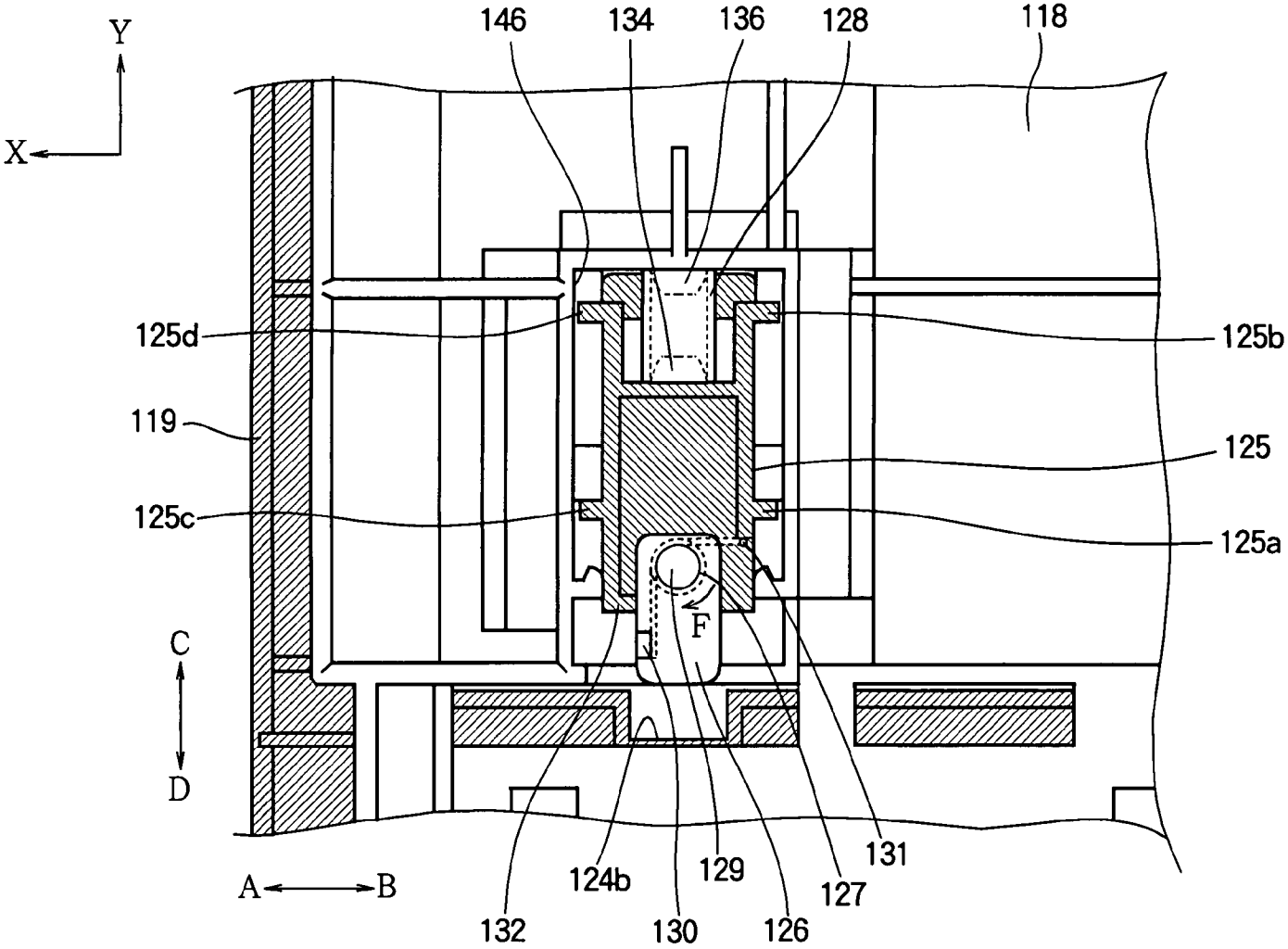
FIG. 8 is a schematic bottom view for illustrating operation of the locking mechanism mounted to the cassette main body and the slide member according to Embodiment 1.
Figure 9:
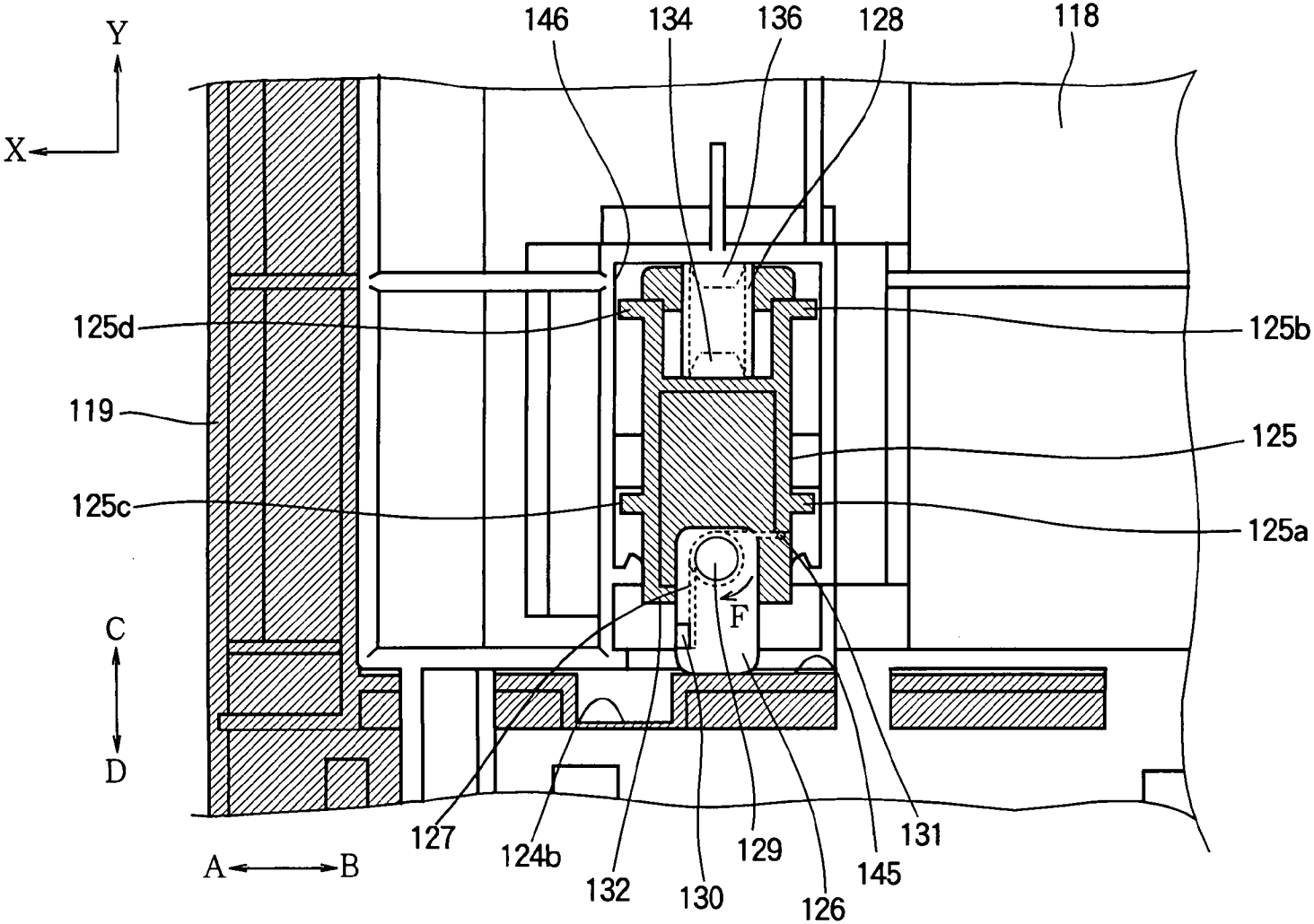
FIG. 9 is a schematic bottom view for illustrating operation of the locking mechanism mounted to the cassette main body and the slide member according to Embodiment 1.

FIGS. 8 through 10 are schematic bottom views for illustrating operation of the locking mechanism 120 (FIG. 5) mounted to the cassette main body 118 and the slide member 119. In FIG. 8 through 10, the slide member 119 is shown with hatching slanting downwardly to the left, and a slide lever 125 of the locking mechanism 120 is shown with hatching slanting downwardly to the right.

For example, in case of storing the recording sheet 116 of "legal-size 14" having the width of 215.9 mm and the length of 335.6 mm in the cassette main body 118, the slide member 119 is moved to the enlarging position. If the slide member 119 is in the retracted position shown in FIG. 6, the arm lever 126 engages the second locking groove 124*b*, and abuts against the stopper portion 132 of the slide lever 125, with the result that the slide member 119 can not be moved in the direction toward the enlarging position as shown by the arrow A. With such a configuration, the slide member 119 is not unintentionally moved to the enlarging position while the recording sheet 116 is stored in the cassette main body 118, and therefore the upstream end of the recording sheet 116 (in the feeding direction of the recording sheet 116) can be surely defined at a desired position. That is, erroneous feeding can be prevented.

In order to move the slide member 119 to the enlarging position, a user puts its finger on the operation portion 133 (FIG. 7) of the slide lever 125, and moves the slide lever 125 outward in the widthwise direction as shown by the arrow C according to the indication by the arrow 135 (FIG. 7) resisting the force of the spring 128. With this, the arm lever 126 moves out the second locking groove 124*b* of the slide member 119 as shown in FIG. 8, and therefore the slide member 119 becomes movable in the direction as shown by the arrow A toward the enlarging position.

After the user moves the slide member 119 toward the enlarging position (in the direction shown by the arrow A in FIG. 9) by approximately 10 mm, the user takes its finger off the operation portion 133 of the slide lever 125. With this, the slide lever 125 is moved by the force of the spring 128 inward in the widthwise direction as shown by the arrow D in FIG. 9. In this state, the second locking groove 124*b* of the slide lever 125 has already moved in the direction shown by the arrow A, and therefore the arm lever 126 does not engage the second locking groove 124*b*, but contacts a wall 145 of the slide member 119. The arm lever 126 is biased by the torsion spring 127, and is kept in contact with the stopper portion 132 of the slide lever 125.

When the first locking groove 124*a* reaches the position of the arm lever 126, the arm lever 126 fits in the first locking groove 124*a* due to the force of the spring 128 as shown in FIG. 10, while the arm lever 126 is kept in contact with the stopper portion 132 of the slide lever 125 due to the force of the torsion spring 127. That is, the arm lever 126 moves to the locking position by itself. Therefore, the slide member 119 is locked in the enlarging position due to the engagement between the arm lever 126 and the first locking groove 124*a*.

Next, operation when a force is applied to the slide member 119 in a direction to retract the slide member 119 into the cassette main body 118 (in a state where the slide member 119 is in the enlarging position) will be described with reference to FIGS. 10 through 12.

When the slide member 119 is locked in the enlarging position, the arm lever 126 engages the first locking groove 124*a*, and the arm lever 126 abuts against the stopper portion 132 of the slide lever 125 as shown in FIG. 10, so that the slide member 119 does not move toward the direction shown by the arrow A.

Figure 11:
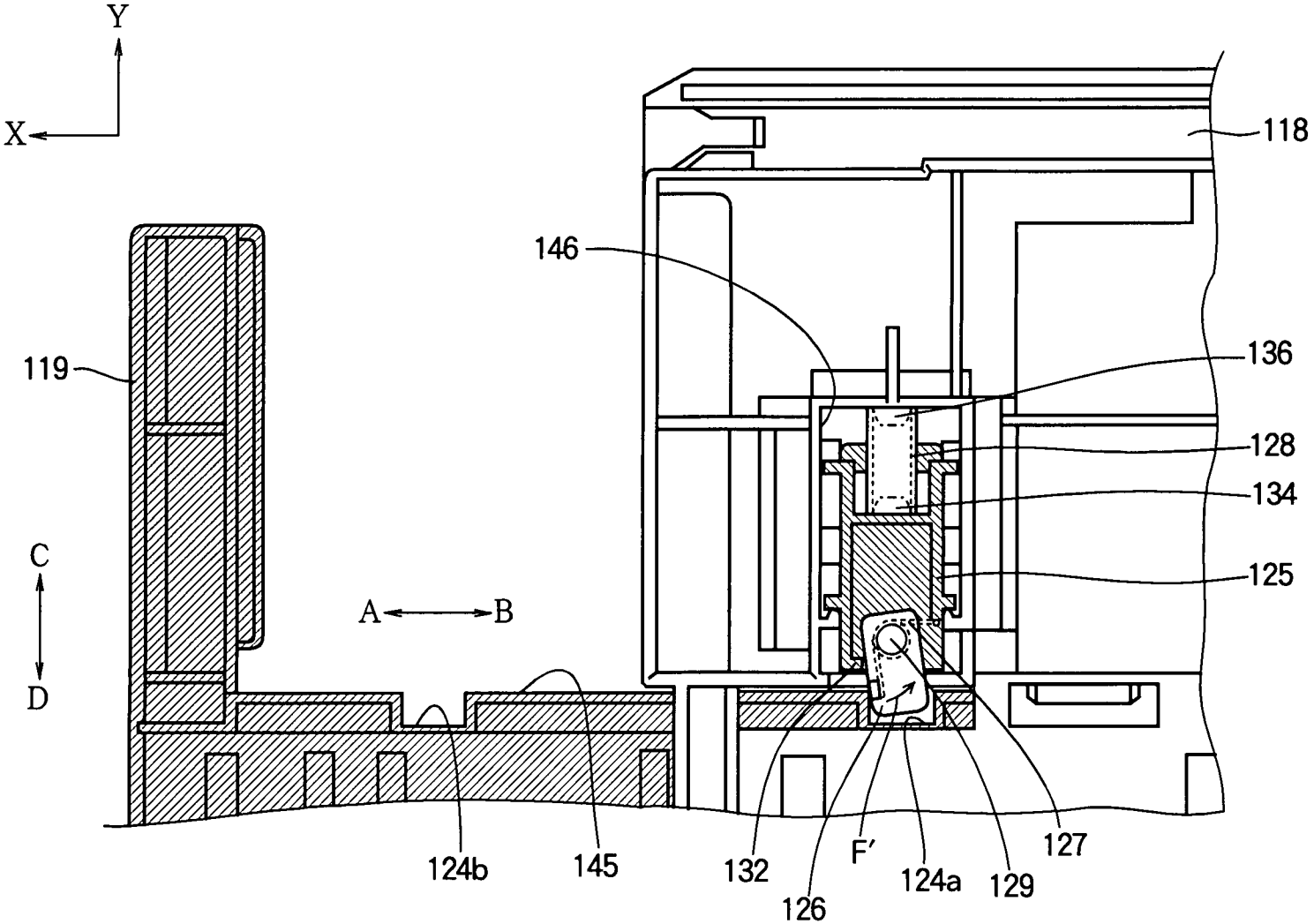
FIG. 11 is a schematic bottom view for illustrating operation of the locking mechanism mounted to the cassette main body and the slide member according to Embodiment 1.

In this state, if a force is applied to the slide member 119 in the direction to retract the slide member 119 into the cassette main body 118 as shown by the arrow B, and if the applied force is greater than the force of the torsion spring 127, the first locking groove 124*a* pushes the arm lever 126 as shown in FIG. 11 to cause the arm lever 126 to rotate about the rotation shaft 129 of the slide lever 125 in the direction (CCW) shown by the arrow F' in FIG. 11. By the rotation of the arm lever 126 in the direction shown by the arrow F', the engagement between the arm lever 126 and the first locking groove 124*a* of the slide member 119 is released. Therefore, the slide member 119 can be moved in the direction as shown by the arrow B, i.e., in the direction to retract the slide member 119 into the cassette main body 118.

Figure 12:
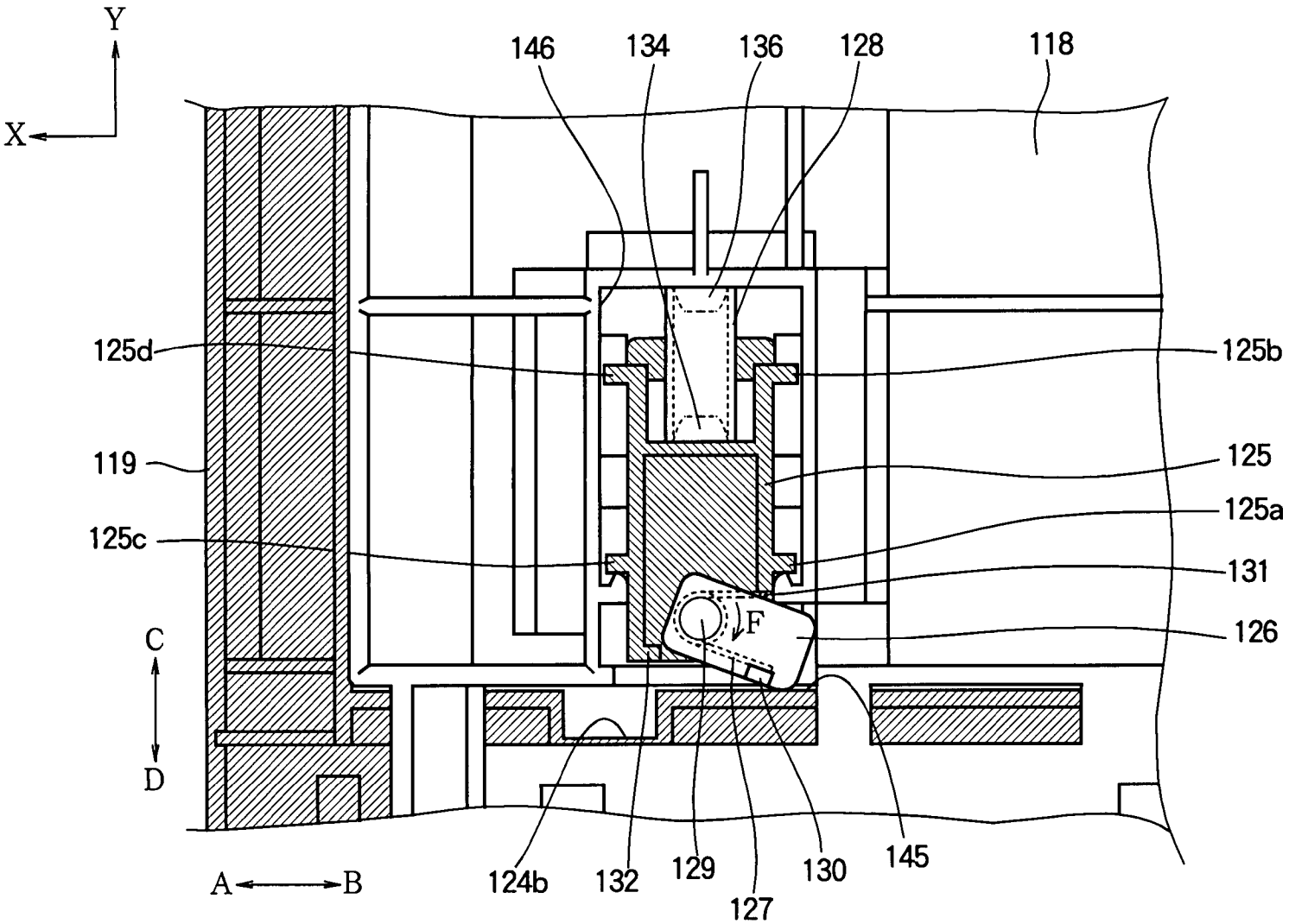
FIG. 12 is a schematic bottom view for illustrating operation of the locking mechanism mounted to the cassette main body and the slide member according to Embodiment 1.

As the slide member 119 moves in the direction to be retracted into the cassette main body 118 (due to the release of engagement between the arm lever 126 and the first locking groove 124*a* of the slide member 119), the arm lever 126 is inclined at a predetermined angle from a position where the arm lever 126 contacts the stopper portion 132 of the slide lever 119 as shown in FIG. 12, and the tip of the arm lever 126 is kept in contact with the wall 145 of the slide member 119 due to the force of the torsion spring 127. In this state, when the second locking groove 124*b* reaches the position of the arm lever 126, the arm lever 126 moves into the second locking groove 124*b* due to the force of the torsion spring 127. That is, the arm lever 126 moves to the locking position by itself. Therefore, the slide member 119 is retracted into the cassette main body 118, and is locked due to the engagement between the arm lever 126 and the second locking groove 124*b* as shown in FIG. 6.

Advantageous of Embodiment 1 will be herein described.

When the slide member 119 (i.e., the cassette extension member) is slid to the protruding position and is locked therein in order to enlarge a space for storing recording sheets 116, there is a possibility that the slide member 119 may contact neighboring objects in the vicinity of the image forming apparatus 107, and may be applied with a force in a direction to retract the slide member 119 into the cassette main body 118. In such a case, it is necessary to prevent application of an excessive force to the parts of the locking mechanism 120, to thereby prevent application of an unwanted force to the sheet feeding cassette 103.

In this regard, according to the sheet feeding cassette 103 of Embodiment 1, when the slide member 119 contacts neighboring objects in the vicinity of the image forming apparatus 107 and is applied with a force (greater than a predetermined force) in a direction to retract the slide member 119 into the cassette main body 118, the arm lever 126 moves out of engagement with the first locking groove 124*a* of the slide member 119. Therefore, it becomes possible to prevent application of excessive force to the arm lever 126. That is, it becomes possible to prevent application of excessive force to the parts of the locking mechanism 120 such as the arm lever 126, the slide lever 125 or the like. Accordingly, it becomes possible to prevent application of unwanted force to the sheet feeding cassette 103.

Moreover, when the slide member 119 is pushed in the direction shown by the arrow B with a force greater than the force of the torsion spring 127, the engagement between the arm lever 126 and the first locking groove 124*a* of the slide member 119 is released so that the slide member 119 becomes movable. Therefore, in order to retract the slide member 119 into the cassette main body 118, it is only necessary for the user to push the slide member 119 in the direction shown by the arrow B resisting the force of the torsion spring 127. Further, when the second locking groove 124*b* of the slide member 119 reaches the position of the arm lever 126, the arm lever 126 engages the second locking groove 124*b* by itself so as to lock the slide member 119 in the retracted position. Therefore, it is not necessary to operate the slide lever 125 in the widthwise direction of the recording sheet 116 (i.e., the directions C and D) in order to retract the slide member 119 into the cassette main body 118. Accordingly, operability and convenience are enhanced.

Embodiment 2

Figure 13:
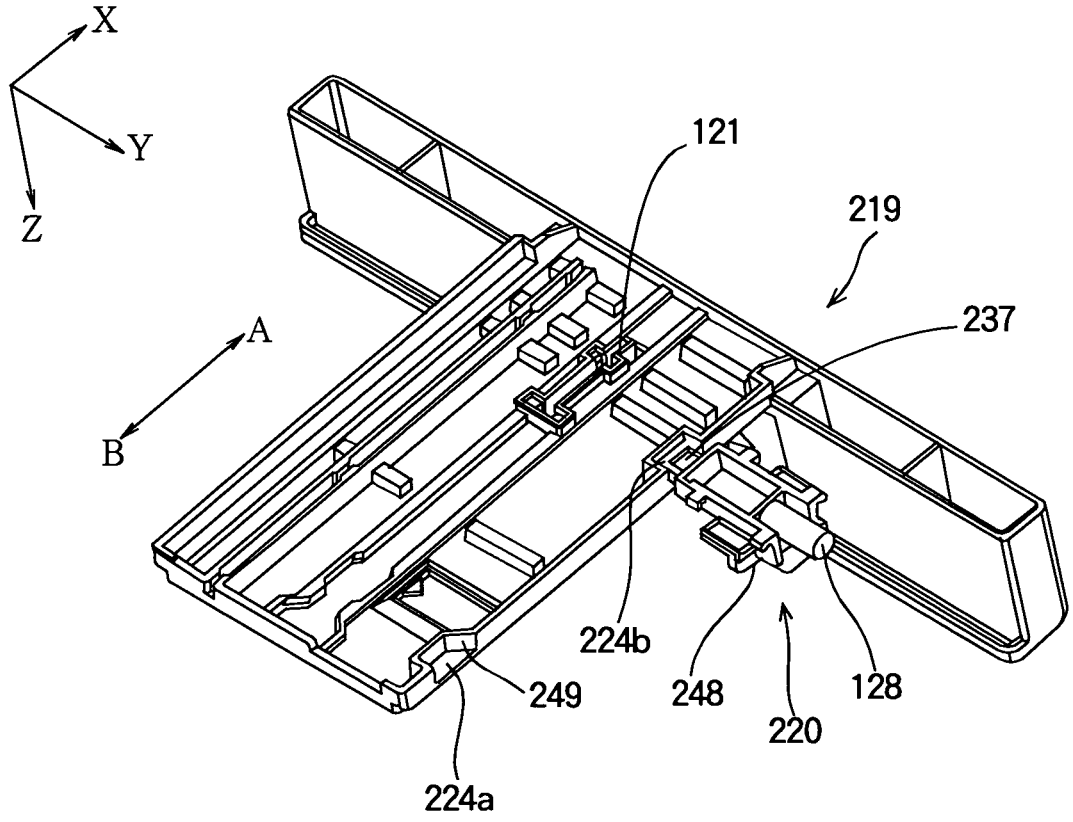
FIG. 13 is a bottom perspective view showing a locking mechanism together with a slide member of a sheet feeding cassette according to Embodiment 2 of the present invention.
Figure 14:
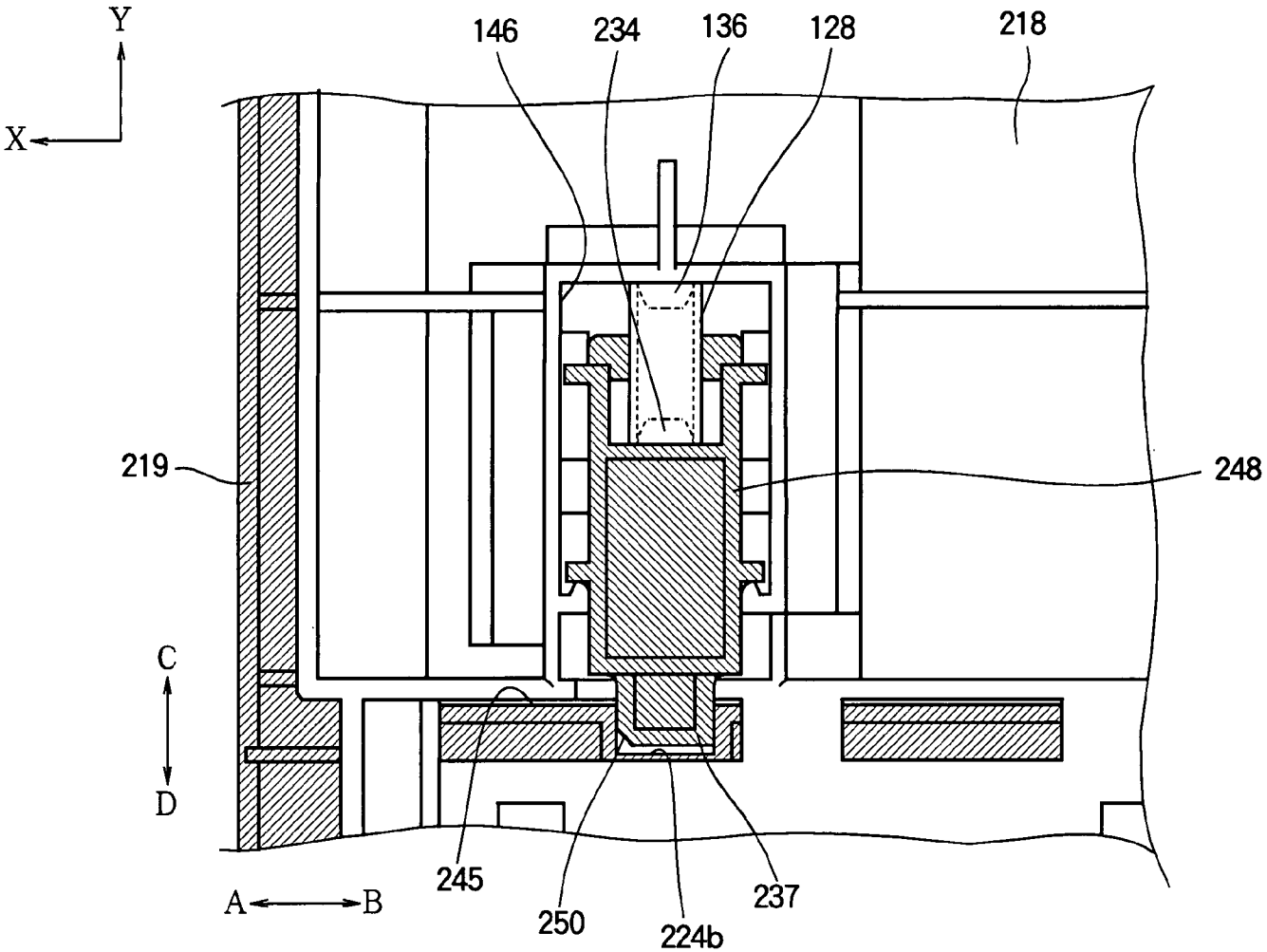
FIG. 14 is a schematic bottom view for illustrating operation of the locking mechanism mounted to a cassette main body and the slide member according to Embodiment 2.
Figure 15:
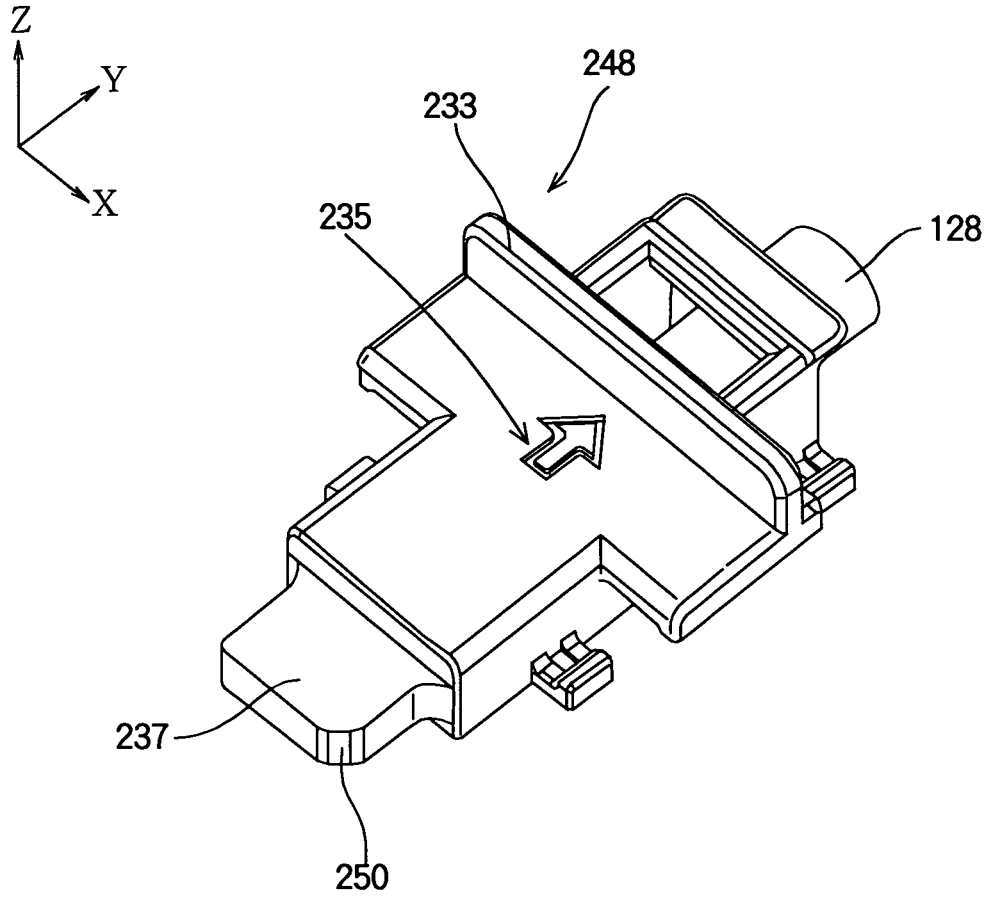
FIG. 15 is a perspective view showing a slide lever and a spring of the locking mechanism according to Embodiment 2.

FIG. 13 is a bottom perspective view showing a slide member 219 and a locking mechanism 220 used in a sheet feeding cassette according to Embodiment 2 of the present invention. FIG. 14 is a schematic bottom view for illustrating operation of the locking mechanism 220 mounted to a cassette main body 218 and the slide member 219. FIG. 15 is a perspective view showing a slide lever 248 of the locking mechanism 220. In FIG. 14, the slide member 219 is shown with hatching slanting downwardly to the left, and the slide lever 248 of the locking mechanism 220 is shown with hatching slanting downwardly to the right.

The sheet feeding cassette according to Embodiment 2 using the slide member 219 shown in FIG. 13 is different from the sheet feeding cassette 103 (FIG. 2) according to Embodiment 1 using the slide member 119 shown in FIG. 5 in the structure of the locking mechanism 220. Therefore, components of the sheet feeding cassette according to Embodiment 2 that are the same as those of Embodiment 1 are assigned the same reference numerals, and descriptions or graphic illustration thereof are omitted. Descriptions herein will be focused on a difference between the sheet feeding cassettes of Embodiments 1 and 2. The image forming apparatus of Embodiment 2 have the same components as the image forming apparatus 107 (FIG. 1) of Embodiment 1, and therefore FIG. 1 will be referred as necessary.

As shown in FIG. 13, the locking mechanism 220 includes first and second locking grooves 224*a* and 224*b*, the slide lever 248 and the spring 128. The first locking groove 224*a* and the second locking groove 224*b* are formed on the slide member 219. The other components (i.e., the slide lever 248 and the spring 128) are mounted to the cassette main body 218. The first locking groove 224*a* and the second locking groove 224*b* are disposed on positions that are apart from each other in the moving direction of the slide member 219, i.e., in the feeding direction of the recording sheet 116. To be more specific, the first locking groove 224*a* and the second locking groove 224*b* are respectively disposed on the downstream side and the upstream side along the feeding direction of the recording sheet 116 shown by the arrow B in FIG. 13.

The first locking groove 224*a* has an inclined surface portion 249 (i.e., a flat contact surface) that contacts the slide lever 248 to bring the slide lever 248 out of engagement with the first locking lever 224*a*, as will be described later. The inclined surface portion 249 is inclined with respect to the moving direction of the slide member 219.

FIGS. 13 and 14 show a state where the slide member 219 is retracted into the cassette main body 218, and is locked due to engagement between the slide lever 248 and the second locking groove 224*b*. The slide lever 248 is held in a locking member holding portion 146 of the cassette main body 218 so that the slide lever 248 is movable in the Y-direction, i.e., the widthwise direction of the recording sheet 116. The slide lever 248 engages the second locking groove 224*b* or the first locking groove 224*a*. The slide lever 248 has a protruding portion 237 protruding in the direction shown by the arrow D, and the protruding portion 237 has an inclined surface portion 250 on a tip thereof. The inclined surface portion 250 is inclined with respect to the moving direction of the slide lever 248. As illustrated in FIGS. 13-14, the protruding portion 237 is convex shaped and the second locking groove 224*b* and the first locking groove 224*a* are each concave shaped.

As shown in FIG. 15, the slide lever 248 has an operation portion 233 which can be operated with a finger for moving the slide lever 248. The slide lever 248 has a pin 234 (FIG. 16) at an end thereof, which receives the end of the spring 128. The pin 234 is disposed so that an axial direction thereof is oriented in a direction parallel to the moving direction of the slide lever 248. Further, an arrow 235 (i.e., an indication mark) is formed integrally on an upper surface of the slide lever 248 as shown in FIG. 15, which indicates a direction from a locking position to a lock-releasing position.

As shown in FIG. 14, the spring 128 (i.e., a first biasing unit) is set in a compressed manner so that an end of the spring 128 engages a pin 136 (as a receiving portion) disposed on the cassette main body 218, and the other end of the spring 128 engages the above described pin 234 of the slide lever 248. The spring 128 biases the slide lever 248 inward in the widthwise direction of the recording sheet 116 as shown by the arrow D, i.e., the direction toward the locking position.

Next, operation of the locking mechanism 220 will be described.

When the slide member 219 is in the retracted position shown in FIG. 14, the protruding portion 237 of the slide lever 248 engages the second locking groove 224*b*, and therefore the slide member 219 can not be moved to the enlarging position in the direction as shown by the arrow A in FIG. 14. With such a configuration, the slide member 219 is not unintentionally moved to the enlarging position while the recording sheet 116 is stored in the cassette main body 218, and therefore the upstream end of the recording sheet 116 (in the feeding direction thereof) can be surely defined at a desired position. That is, erroneous feeding can be prevented.

In order to move the slide member 219 to the enlarging position, a user puts its finger on the operation portion 233 (FIG. 15) of the slide lever 248, and moves the slide lever 248 outward in the widthwise direction of the recording sheet 116 as shown by the arrow C according to the indication by the arrow 235 (FIG. 15) resisting the force of the spring 128. With this, the protruding portion 237 of the slide member 219 moves out of the second locking groove 224*b* of the slide member 219, and therefore the slide member 219 becomes movable in the direction as shown by the arrow A toward the enlarging position.

After the user moves the slide member 219 toward the enlarging position (in the direction shown by the arrow A in FIG. 14) by approximately 10 mm, and takes its finger off the operation portion 233 of the slide lever 248. With this, the slide lever 248 moves inward in the widthwise direction as shown by the arrow D. In this state, the second locking groove 224*b* has already moved in the direction shown by the arrow A, and therefore the protruding portion 237 of the slide lever 248 does not engage the second locking groove 224*b*, but contacts a wall 245 of the slide member 219.

Figure 16:
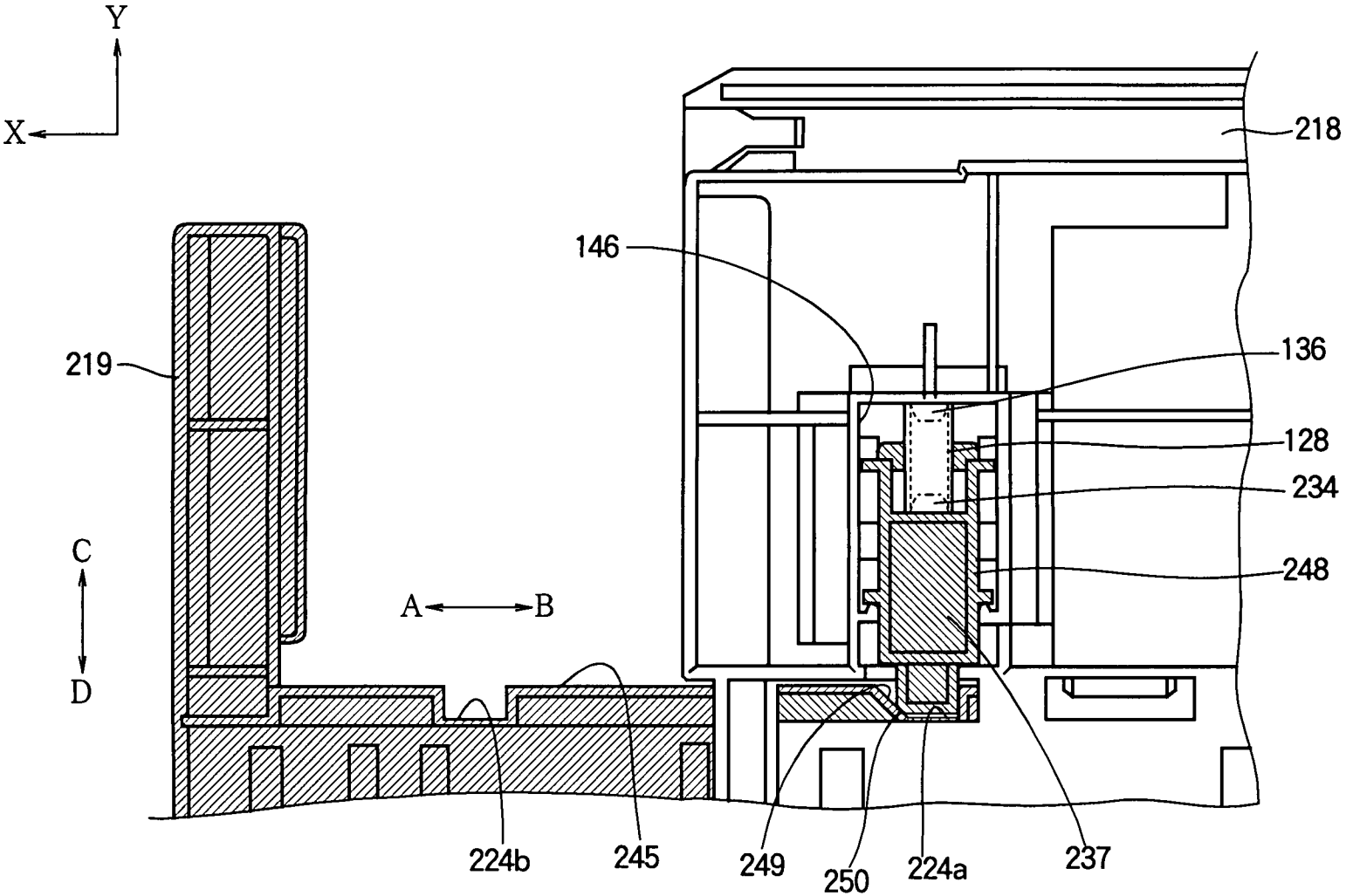
FIG. 16 is a schematic bottom view for illustrating operation of the locking mechanism mounted to the cassette main body and the slide member according to Embodiment 2.

When the first locking groove 224*a* reaches the position of the slide lever 248, the protruding portion 237 of the slide lever 248 fits in the first locking groove 224*a* due to the force of the spring 128 as shown in FIG. 16. That is, the slide lever 248 moves to the locking position by itself. Therefore, the slide member 219 is locked in the enlarging position due to the engagement between the protruding portion 237 of the slide lever 248 and the first locking groove 224*a*.

Figure 17:
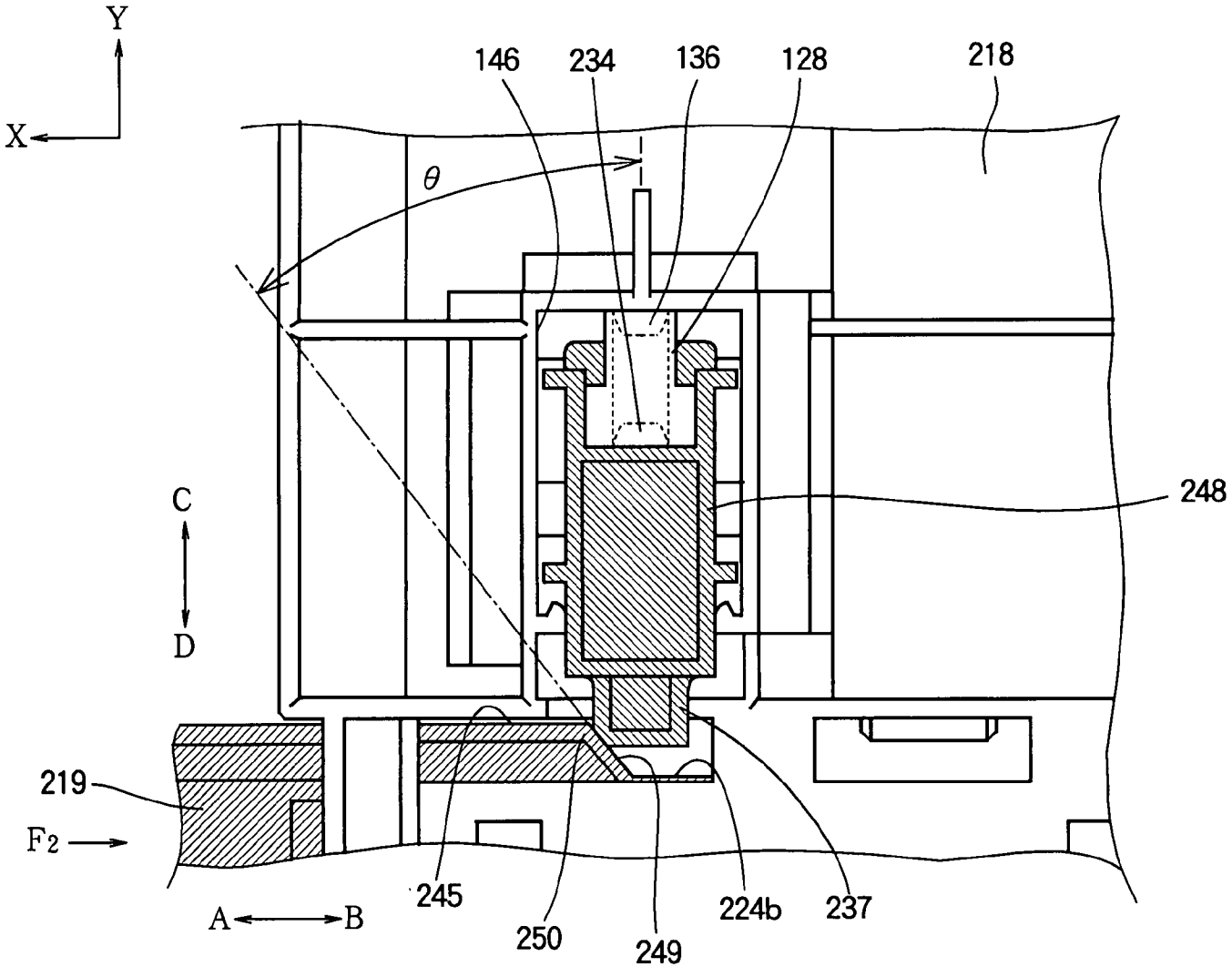
FIG. 17 is a schematic view for illustrating an angle θ of an inclined surface portion of a first locking groove of the slide member according to Embodiment 2.

Next, operation when a force is applied to the slide member 219 in a direction to retract the slide member 219 into the cassette main body 218 (in a state where the slide member 219 is in the enlarging position) will be described with reference to FIGS. 16 and 17.

When the slide member 219 is locked in the enlarging position, the protruding portion 237 of the slide lever 248 engages the first locking groove 224*a*, and therefore the slide member 219 does not move toward the direction shown by the arrow A.

In this state, if a force is applied to the slide member 219 in the direction to retract the slide member 219 into the cassette main body 218 as shown by the arrow B, the inclined surface portion 249 of the first locking groove 224*a* abuts against the inclined surface portion 250 of the protruding portion 237 of the slide lever 248 to cause the slide lever 248 to move outward (as shown by the arrow C) in the width direction of the recording sheet 116 resisting the force of the spring 128. With this movement of the slide lever 248, the protruding portion 237 moves out of engagement with the first locking groove 224*a* of the slide member 219, and the slide member 119 becomes movable in the direction shown by the arrow B, i.e., the direction to retract the slide member 219 into the cassette main body 218.

In this regard, the inclined surface portion 250 of the protruding portion 237 of the slide lever 248 is configured to make face-to-face contact with the inclined surface portion 249 of the first locking groove 224*a*. However, other configuration is employable. For example, the inclined surface portion 250 of the protruding portion 237 of the slide lever 248 can have an arcuate cross-section so as to make line contact with the inclined surface portion 249 of the first locking groove 224*a*.

While the slide member 219 moves in the direction to be retracted into the cassette main body 218 (due to the release of engagement between the protruding portion 237 of the slide lever 248 and the first locking groove 224*a* of the slide member 219), the protruding portion 237 of the slide lever 248 is kept in contact with the wall 245 of the slide member 219 due to the force of the spring 128. In this state, when the second locking groove 224*b* reaches the position of the protruding portion 237 of the slide lever 248, the protruding portion 237 of the slide lever 248 moves into the second locking groove 224*b* due to the force of the spring 128. That is, the slide lever 248 moves to the locking position by itself. Therefore, the slide member 219 is retracted into the cassette main body 218 as shown in FIG. 14, and is locked due to the engagement between the protruding portion 237 of the slide lever 248 and the second locking groove 224*b*.

Here, description will be made to a relationship between a force required for releasing the engagement between the first locking groove 224*a* of the slide member 219 and the protruding portion 237 of the slide lever 248 and a force of the spring 128 in a state where slide member 219 is in the enlarging position (i.e., where the protruding portion 237 of the slide lever 248 engages the first locking groove 224*a*) with reference to FIG. 17.

Here, a force $F_2$ represents a force with which the slide member 219 is pushed in the direction to retract the slide member 219 into the cassette main body 218. An angle θ represents an angle between the moving direction of the slide lever 248 (shown by the arrow D) and the inclined surface portion 249 of the first locking groove 224*a*, which is the same as an angle between the moving direction of the slide lever 248 and the inclined surface portion 250 of the protruding portion 237 of the slide lever 248. A force $F_1$ represents a force with which the spring 128 biases the slide lever 248 when the protruding portion 237 of the slide lever 248 contacts the wall 245 of the slide member 219. A relationship for releasing the engagement between the first locking groove 224*a* and the protruding portion 237 of the slide lever 248 is as follows:

$$F_2 > F_1/\tan\theta$$

For example, when $F_1$ is 100 gf and θ is 45 degrees, it is necessary to push the slide member 219 with a force greater than $F_2$=100 gf, in order to release the engagement between the first locking groove 224*a* of the slide member 219 and the protruding portion 237 of the slide lever 248.

As described above, according to the sheet feeding cassette of Embodiment 2, when the slide member 219 contacts neighboring objects in the vicinity of the image forming apparatus 107 and is applied with a force (greater than a predetermined force) in a direction to retract the slide member 219 into the cassette main body 218, the protruding portion 237 of the slide lever 248 moves out of engagement with the first locking groove 224*a* of the slide member 219. Therefore, it becomes possible to prevent application of excessive force to the slide lever 248. That is, it becomes possible to prevent application of excessive force to the parts of the locking mechanism 220 such as the slide lever 248 or the like. Accordingly, it becomes possible to prevent application of unwanted force to the sheet feeding cassette, as in Embodiment 1.

Moreover, when the slide member 219 is pushed in the direction shown by the arrow B resisting the force of the spring 128, the engagement between the slide lever 248 and the first locking groove 224*a* of the slide member 219 is released so that the slide member 219 becomes movable. Therefore, in order to retract the slide member 219 into the cassette main body 218, it is only necessary for the user to push the slide member 219 in the direction shown by the arrow B resisting the force of the spring 128. Further, when the second locking groove 224*b* reaches the position of the slide lever 248, the protruding portion 237 of the slide lever 248 engages the second locking groove 224*b* by itself so as to lock the slide member 219. Therefore, it is not necessary to operate the slide lever 248 in the widthwise direction of the recording sheet 116 (i.e., the directions C and D) in order to retract the slide member 219 into the cassette main body 218. Accordingly, operability and convenience are enhanced.

Furthermore, although the locking member according to Embodiment 1 includes the slide lever 125, the arm lever 126 and the torsion spring 127, the locking member according to Embodiment 2 includes the slide lever 248 only. Therefore, according to Embodiment 2, the configuration of the sheet feeding cassette 103 can be simplified, and cost thereof can be reduced.

In the above described embodiments, the image forming apparatus having one image forming portion and configured to directly transfer a toner image to a medium has been described. However, the present invention is not limited to such an image forming apparatus. The present invention is applicable to a color image forming apparatus using an intermediate transfer belt, a color image forming apparatus using a plurality of process units or other image forming apparatus that performs image processing on a medium which is being fed. Further, the present invention is applicable to a copier, an automatic manuscript reading apparatus, an ink jet printer, a dot printer, a combined machine or a medium supplying apparatus.

While the preferred embodiments of the present invention have been illustrated in detail, it should be apparent that modifications and improvements may be made to the invention without departing from the spirit and scope of the invention as described in the following claims.

What is claimed is:

1. A medium feeding cassette for storing a medium, said medium feeding cassette comprising:

a cassette main body;

a cassette extension member mounted to said cassette main body and provided so as to align the medium and extend from said cassette main body at an upstream side of said cassette main body in a feeding direction of said medium, said cassette extension member being movable with respect to said cassette main body;

a locking mechanism configured to lock said cassette extension member in a predetermined position with respect to said cassette main body according to a size of said medium, said locking mechanism comprising a first locking portion and a second locking portion that engage each other so as to lock said cassette extension member in said predetermined position, said first locking portion comprises a convex portion and said second locking portion comprises concave portions, wherein said concave portions comprise a first concave portion that holds said cassette extension member at an extending position where said cassette extension member protrudes from said cassette main body, and a second concave portion that holds said cassette extension member at a retracting position where said cassette extension member is retracted from said extending position, the locking mechanism includes a flat portion disposed between the first concave portion and the second concave portion;

a first releasing mechanism that releases locking of said cassette extension member by said locking mechanism; and a second releasing mechanism that releases locking of said cassette extension member by said locking mechanism, said second releasing mechanism being operable independently from said first releasing mechanism, wherein said convex portion moves in a direction to release locking of said cassette extension member when a force is applied to any portion of said cassette extension member in a direction to retract said cassette extension member into said cassette main body.

2. An image forming apparatus comprising said medium feeding cassette according to claim 1.

3. The medium feeding cassette according to claim 1, wherein said cassette extension member comprises:

a rear end guide member that defines a position of an upstream end of said medium in a feeding direction of said medium; and a to-be-guided portion guided by a bottom portion of said cassette main body, said bottom portion being configured to define a placing surface on which said medium is placed.

4. The medium feeding cassette according to claim 3, wherein said cassette main body has a guide groove extending in said feeding direction of said medium, and said to-be-guided portion is disposed on substantially a center portion of said cassette main body in a widthwise direction of said medium, and wherein said to-be-guided portion is guided by said guide groove and moves in said feeding direction of said medium.

5. The medium feeding cassette according to claim 3, wherein said rear end guide member is supported so as to be movable in said feeding direction of said medium.

6. The medium feeding cassette according to claim 3, wherein a width of said to-be-guided portion in a widthwise direction of said medium is narrower than a width of said cassette main body in said widthwise direction.

7. An image forming apparatus comprising said medium feeding cassette according to claim 3.

8. The medium feeding cassette according to claim 1, wherein, when an external force is applied to any portion of said cassette extension member, one of said first and second releasing mechanisms releases the locking of said cassette extension member by said locking mechanism.

9. The medium feeding cassette according to claim 1, wherein the cassette main body has a downstream side along the feeding direction of said medium, the cassette extension member extends from the upstream side of said cassette main body in a predetermined direction directed from a leading end of said medium toward a trailing end of said medium along the feeding direction of said medium, the extending position being a position in the predetermined direction and the retracting position being a position where said cassette extension member is retracted into said cassette main body, and when said cassette extension member is in the extending position and when a force is applied to an end portion of said cassette extension member at an upstream side of said cassette extension member, said convex portion moves in the direction to release locking of said cassette extension member to retract said cassette extension member into said cassette main body so that said cassette extension member moves from the extending position to the retracting position.

10. The medium feeding cassette according to claim 1, wherein said cassette extension member has a rear cover that covers an upstream end of said medium in said feeding direction, and wherein, in a state where said cassette extension member is in the extending position so as to protrude from said cassette main body, a space is formed between said rear cover and a portion of said cassette main body that is positioned further upstream in the feeding direction of the medium than any other portion of said cassette main body.

11. The medium feeding cassette according to claim 1, wherein said cassette extension member has a rear cover that covers an upstream end of said medium in said feeding direction, wherein said rear cover has a brim which is distanced from a bottom portion of the cassette main body.

12. The medium feeding cassette according to claim 1, wherein said cassette extension member has a rear cover that covers an upstream end of said medium in said feeding direction, wherein the cassette extension member does not protrude from said cassette main body in the retracted position, and further wherein said cassette main body has a supporting portion that supports said rear cover in said retracted position.

13. The medium feeding cassette according to claim 1, wherein the second locking portion is disposed between said cassette extension member and the convex portion so as to touch both said cassette extension member and said convex portion.

14. The medium feeding cassette according to claim 1, wherein the first releasing mechanism biases said first locking portion in a direction in which said convex portion of said first locking portion is engageable with one of the concave portions of the second locking portion.

15. The medium feeding cassette according to claim 14, wherein the first releasing mechanism is a compression spring.

16. The medium feeding cassette according to claim 1, wherein said second releasing mechanism biases said first locking portion in a direction in which said convex portion of said first locking portion is engageable with one of the concave portions of the second locking portion, wherein said second releasing mechanism allows said convex portion to disengage from one of the concave portions when said force is applied to said cassette extension member in a direction to retract said cassette extension member into said main body.

17. The medium feeding cassette according to claim 16, wherein the first releasing mechanism is a compression spring.

18. A medium feeding cassette for storing a medium, said medium feeding cassette comprising:

a cassette main body;

a cassette extension member mounted to said cassette main body so as to be movable with respect to said cassette main body; and a locking mechanism configured to lock said cassette extension member in a predetermined position with respect to said cassette main body according to a size of said medium, wherein said locking mechanism includes a first locking portion and a second locking portion that engage each other so as to lock said cassette extension member in said predetermined position, wherein said first locking portion moves in a direction to release locking of said cassette extension member when a force is applied to said cassette extension member in a direction to retract said cassette extension member into said cassette main body, wherein said second locking portion is disposed on said cassette extension member, wherein said first locking portion is mounted to said cassette main body so as to be movable in a direction perpendicular to a moving direction of said cassette extension member, and wherein a first biasing unit is provided for biasing said first locking portion in a direction toward said cassette extension member.

19. The medium feeding cassette according to claim 18, wherein said first locking portion includes:

a first lever biased by said first biasing unit;

a second lever supported by said first lever so as to be rotatable between a first rotational position where said second lever engages said second locking portion and a second rotational position where said second lever is released from engagement with said second locking portion; and a second biasing unit that biases said second lever toward said first rotational position, wherein, when said force is applied to said cassette extension member in said direction to retract said cassette extension member into said cassette main body, said second lever rotates from said first rotational position to said second rotational position, and is prevented from rotating in a direction from said second rotational position toward said first rotational position.

20. The medium feeding cassette according to claim 18, wherein said first locking portion includes a protruding portion which is engageable with said second locking portion, wherein said second locking portion has a flat contact surface that biases said protruding portion according to said force applied to said cassette extension member in said direction to retract said cassette extension member into said cassette main body, and wherein said flat contact surface is inclined at an angle $\theta$ with respect to a moving direction of said cassette extension member so as to generate a force with which said first locking portion is released from engagement with said second locking portion.

21. The medium feeding cassette according to claim 20, wherein said protruding portion has a flat surface portion that makes face-to-face contact with said flat contact surface.

22. The medium feeding cassette according to claim 20, wherein, when said force applied to said cassette extension member in said direction to retract said cassette extension member into said main cassette is expressed as F2 and a force generated by said first biasing unit is expressed as F1, a condition for releasing said first locking portion from engagement with said second locking portion is expressed as follows:

$$F2 > F1/\tan\theta.$$

23. The medium feeding cassette according to claim 18, wherein said locking mechanism includes a third locking portion disposed on said cassette main body, the third locking portion for engaging said first locking portion in a state where said cassette extension member is retracted into said cassette main body.

24. The medium feeding cassette according to claim 23, wherein said first locking portion has an indication mark that indicates a direction to move said first locking portion for releasing said first locking portion from engagement with said third locking portion resisting a force of said first biasing member.

25. A medium feeding cassette for storing a medium, said medium feeding cassette comprising:

a cassette main body;

a cassette extension member mounted to said cassette main body so as to be movable with respect to said cassette main body;

a rear end guide member provided on said cassette extension member, said rear end guide member defining an upstream end of said medium in a feeding direction of said medium; and a locking mechanism configured to lock said cassette extension member in a predetermined position with respect to said cassette main body according to a size of said medium, wherein said locking mechanism includes a first locking portion and a second locking portion that engage each other so as to lock said cassette extension member in said predetermined position, wherein said first locking portion moves in a direction to release locking of said cassette extension member when a force is applied to said cassette extension member in a direction to retract said cassette extension member into said cassette main body, wherein said cassette extension member includes:

a to-be-guided portion guided by a bottom portion of said cassette main body, said bottom portion being configured to define a placing surface on which said medium is placed, said to-be-guided portion including a holding portion that holds said medium in a state where said cassette extension member extends from said cassette main body, and a rear cover that covers an upstream end of said medium in said feeding direction, a width of said rear cover in a widthwise direction of said medium being wider than a width of said holding portion in said widthwise direction.

26. An image forming apparatus comprising said medium feeding cassette according to claim 25.

27. The medium feeding cassette according to claim 25, wherein the width of the holding portion is smaller than a width of said medium in the widthwise direction.

28. The medium feeding cassette according to claim 25, wherein said to-be-guided portion touches said medium in the state where said cassette extension member extends from said cassette main body, further wherein the cassette extension member has outer edges that are outermost edges thereof in a direction perpendicular to the feeding direction, further wherein the rear end guide member has outer edges that are outermost edges thereof in the direction perpendicular to the feeding direction, further wherein a distance between the outer edges of the rear end guide member is less than a distance between the outermost edges of the cassette extension member.

29. A medium feeding cassette for storing a medium, said medium feeding cassette comprising:

a cassette main body;

a cassette extension member mounted to said cassette main body and provided so as to extend from said cassette main body at an upstream side of said cassette main body in a feeding direction of said medium, said cassette extension member being movable with respect to said cassette main body;

an end guide for defining an end of the medium; and a locking mechanism configured to lock said cassette extension member in a predetermined position with respect to said cassette main body according to a size of said medium, said locking mechanism comprising a first locking portion and a second locking portion that engage each other so as to lock said cassette extension member in said predetermined position, said first locking portion comprising a convex portion and said second locking portion comprising concave portions, wherein said concave portions comprise a first concave portion that holds said cassette extension member at an extending position where said cassette extension member protrudes from said cassette main body, said first concave portion including an inclined surface that is provided at an upstream side of said first concave portion in said feeding direction of said medium, said first concave portion forming an aperture for receiving a part of the convex portion, the entire aperture having a different shape from the entire part of the convex portion, and a second concave portion that holds said cassette extension member at a retracting position where said cassette extension member is retracted from said extending position, the locking mechanism includes a flat portion disposed between the first concave portion and the second concave portion;

a first releasing unit that releases locking of said end guide with respect to said cassette extension member; and a second releasing unit that releases locking of said cassette extension member by said locking mechanism, said second releasing mechanism being operable independently from said first releasing unit, wherein said convex portion moves in a direction to release locking of said cassette extension member when a force is applied to any portion of said cassette extension member in a direction to retract said cassette extension member into said cassette main body.

30. The medium feeding cassette according to claim 29, wherein said first concave portion and said convex portion each has a width in said feeding direction of said medium, the width of the concave portion being greater than the width of said convex portion.

31. The medium feeding cassette according to claim 29, wherein said first concave portion has an inclined surface portion, but said second concave portion has no inclined surface portion.

32. The medium feeding cassette according to claim 29, wherein said first concave portion has a substantially trapezoid shape, and said convex portion has a substantially rectangular shape.

33. The medium feeding cassette according to claim 29, wherein said first concave portion has an inner wall on an upstream side in said feeding direction of said medium, and wherein said inner wall is inclined with respect to a side of said convex portion corresponding to said inner wall.

34. The medium feeding cassette according to claim 29, wherein said first concave portion has a first side including the inclined surface, and said convex portion has a second side facing said first side, wherein said first side is inclined with respect to said second side.

35. The medium feeding cassette according to claim 29, wherein said first concave portion includes three sides.

36. The medium feeding cassette according to claim 29, wherein said first concave portion and said convex portion have different surface profiles from each other.

37. The medium feeding cassette according to claim 29, wherein said inclined surface of said first concave portion has an inclined surface portion that is inclined relative to said feeding direction, and said second concave portion only has sides which are each parallel to the feeding direction or perpendicular to the feeding direction.

* * * * *